US008558825B2

(12) United States Patent
Bae et al.

(10) Patent No.: US 8,558,825 B2
(45) Date of Patent: Oct. 15, 2013

(54) ORGANIC LIGHT EMITTING DIODE DISPLAY AND METHOD FOR DRIVING THE SAME

(75) Inventors: Hanjin Bae, Seoul (KR); Bumsik Kim, Suwon-si (KR); Yunsik Jeong, Busan (KR); Seungtae Kim, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 380 days.

(21) Appl. No.: 12/953,028

(22) Filed: Nov. 23, 2010

(65) Prior Publication Data

US 2011/0122119 A1 May 26, 2011

(30) Foreign Application Priority Data

Nov. 24, 2009 (KR) ..... 10-2009-0113979

(51) Int. Cl.
*G09G 5/00* (2006.01)

(52) U.S. Cl.
USPC ..... 345/211; 345/76; 345/77; 345/204; 345/690; 315/169.3; 315/204; 315/82

(58) Field of Classification Search
USPC ..... 345/76–102, 211, 690–691, 204; 315/169.2–169.3; 313/463
See application file for complete search history.

(56) References Cited

U.S. PATENT DOCUMENTS

2004/0066358 A1* 4/2004 Numao ..... 345/76
2007/0195020 A1 8/2007 Nathan et al.
2008/0252568 A1* 10/2008 Kwon ..... 345/76
2009/0027377 A1* 1/2009 Kwon ..... 345/214
2010/0277400 A1* 11/2010 Jeong ..... 345/76

FOREIGN PATENT DOCUMENTS

CN 101354864 A 1/2009
TW 200820201 A 5/2008

OTHER PUBLICATIONS

Office Action issued in corresponding Chinese Patent Application No. 201010569211.9, mailed Jan. 7, 2013.
Office Action issued in corresponding Taiwan Patent Application No. 099140348, mailed Apr. 10, 2013.

* cited by examiner

*Primary Examiner* — Joe H Cheng
*Assistant Examiner* — Md Saiful A Siddiqui
(74) *Attorney, Agent, or Firm* — Brinks Hofer Gilson & Lione

(57) ABSTRACT

Disclosed are an organic light emitting diode display, which can reduce image sticking caused by the deterioration of an organic light emitting diode, and a driving method thereof. The organic light emitting diode display comprises: a display panel comprising a plurality of pixels arranged in a matrix at intersections of gate line portions and data line portions and each having an organic light emitting diode; a memory for storing compensation data; a timing controller for modulating input digital video data based on the compensation data and generating modulated data; and a data driving circuit for, during compensation driving, generating the compensation data to compensate for a difference in the deterioration of the organic light emitting diodes by supplying a sensing voltage to the pixels and sampling the threshold voltage of the organic light emitting diodes, which is fed back from the pixels, and for, during normal driving, converting the modulated data into a data voltage and supplying the data voltage to the pixels.

14 Claims, 26 Drawing Sheets

ORGANIC LIGHT EMITTING DIODE DISPLAY AND METHOD FOR DRIVING THE SAME

This application claims the benefit of Korea Patent Application No. 10-2009-0113979 filed on Nov. 24, 2009, which is incorporated herein by reference for all purposes as if fully set forth herein.

BACKGROUND

1. Field

This document relates to an organic light emitting diode display, and more particularly, to an organic light emitting diode display, which can reduce image sticking caused by the deterioration of an organic light emitting diode, and a driving method thereof.

2. Related Art

Recently, organic light emitting diode displays spotlighted as display devices have the advantages of a rapid response speed, high emission efficiency, high luminance, and wide viewing angle by using a self-luminous device, which emits light by itself.

An organic light emitting diode display has an organic light emitting diode as shown in FIG. 1. The organic light emitting diode is provided with organic compound layers HIL, HTL, EML, ETL, and EIL formed between an anode and a cathode.

The organic compound layers comprise a hole injection layer HIL, a hole transport layer a hole transport layer HTL, an emission layer EML, an electron transport layer ETL, and an electron injection layer EIL. When a driving voltage is applied to the anode electrode and the cathode electrode, holes passing through the hole transport layer HTL and electrons passing through the electron transport layer ETL move to the emission layer EML to form excitons. As a result, the emission layer EML generates visible light.

The organic light emitting diode display includes a plurality of pixels arranged in a matrix, each pixel including the organic light emitting diode. The organic light emitting diode controls the brightness of selected pixels in accordance with the gray scale of video data.

FIG. 2 equivalently shows one pixel in an organic light emitting diode display. Referring to FIG. 2, an pixel of an active matrix type organic light emitting diode display comprises an organic light emitting diode OLED, data lines DL and gate lines GL that cross each other, a switching thin film transistor SW, a drive thin film transistor DT, and a storage capacitor Cst. The switching TFT SW and the driving TFT DT may be a P-type MOSFET.

The switching TFT SW is turned on in response to a scan pulse received through the gate line GL, and thus a current path between a source electrode and a drain electrode of the switching TFT SW is turned on. During on-time of the switching TFT SW, a data voltage received from the data line DL is applied to a gate electrode of the driving TFT DT and the storage capacitor Cst. The driving TFT DT controls a current flowing in the organic light emitting diode OLED depending on a voltage difference Vgs between the gate electrode and a source electrode of the driving TFT DR. The storage capacitor Cst keeps a gate potential of the driving TFT DR during a frame period. The organic light emitting diode OLED may have a structure shown in FIG. 1. The organic light emitting diode OLED is connected between the source electrode of the driving TFT DT and a low potential driving voltage source VSS.

In general, non-uniformity between luminances of pixels occurs due to various causes, e.g., a difference in the electrical characteristics of driving TFTs, a difference in high potential driving voltage according to display positions, and a difference in the deterioration of organic light emitting diodes. Particularly, the difference in the deterioration of organic light emitting diodes occurs because the rate of deterioration varies from pixel to pixel in the case of long time driving. When this difference becomes severe, an image sticking phenomenon occurs. As a result, picture quality is deteriorated.

To compensate for the difference in the deterioration of the organic light emitting diodes, an external compensation technique and an internal compensation technique are known.

In the external compensation technique, a current source is placed outside a pixel, a constant current is applied to the organic light emitting diode via the current source, and then a voltage corresponding to the current is measured, thereby compensating for the difference in the deterioration of the organic light emitting diode. However, this technique requires all the parasitic capacitors of the data lines to be charged by current flowing in the data lines between the current source and the organic light emitting diode in order to sense an anode voltage of the organic light emitting diode, thus making the sensing speed very slow and lengthening the time required for the sensing. As a result, it is difficult to sense an anode voltage of the organic light emitting diode during time periods between adjacent frames or during the on/off of the display device.

In the internal compensation technique, a coupling capacitor is connected between the anode of the organic light emitting diode and a gate of the driving TFT to automatically reflect the degree of deterioration of the organic light emitting diode to a current flowing in the organic light emitting diode. However, with this technique, it is difficult to perform an accurate compensation because the magnitude of current is varied depending on the turn-on voltage of the organic light emitting diode using the current expression of the driving TFT, and a complicated pixel structure is required. Since the rate of deterioration of the organic light emitting diode is low, it is not necessary to compensate for the difference in the deterioration of the organic light emitting diodes while making the pixel structure complicated.

SUMMARY

An organic light emitting diode display, comprises: a display panel comprising a plurality of pixels arranged in a matrix at intersections of gate line portions and data line portions and each having an organic light emitting diode; a memory for storing compensation data; a timing controller for modulating input digital video data based on the compensation data and generating modulated data; and a data driving circuit for, during compensation driving, generating the compensation data to compensate for a difference in the deterioration of the organic light emitting diodes by supplying a sensing voltage to the pixels and sampling the threshold voltage of the organic light emitting diodes, which is fed back from the pixels, and for, during normal driving, converting the modulated data into a data voltage and supplying the data voltage to the pixels.

Another exemplary embodiment of the present invention provides an organic light emitting diode display, comprising: a display panel comprising a plurality of pixels arranged in a matrix at intersections of gate line portions and data line portions and each having an organic light emitting diode and a driving TFT; a memory for storing compensation data; a timing controller for modulating input digital video data based on the compensation data and generating modulated data; and a data driving circuit for, during compensation driving, generating the compensation data to compensate for a difference in the deterioration of the organic light emitting diodes and a difference in the deterioration of the driving TFTs by supplying first and second sensing voltages to the pixels and sampling the threshold voltage of the organic light emitting diodes and the threshold voltage of the driving TFTs, which are fed back from the pixels, and for, during normal driving, converting the modulated data into a data voltage and supplying the data voltage to the pixels.

One exemplary embodiment of the present invention provides a driving method of an organic light emitting diode display comprising a plurality of pixels each having an organic light emitting diode and connected to data lines, the method comprising: (A) generating compensation data to compensate for a difference in the deterioration of the organic light emitting diodes by supplying a sensing voltage to the pixels and sampling the threshold voltage of the organic light emitting diodes, which is fed back from the pixels; (B) generating modulated data by modulating input digital video data based on the compensation data; and (C) converting the modulated data into a data voltage and supplying the data voltage to the pixels.

Another exemplary embodiment of the present invention provides a driving method of an organic light emitting diode display comprising a plurality of pixels each having an organic light emitting diode and a driving TFT and connected to data lines, the method comprising: (A) generating compensation data to compensate for a difference in the deterioration of the organic light emitting diodes and a difference in the deterioration of the driving TFTs by supplying first and second sensing voltages to the pixels and sampling the threshold voltage of the organic light emitting diodes and the threshold voltage of the driving TFTs, which are fed back from the pixels; (B) generating modulated data by modulating input digital video data based on the compensation data; and (C) converting the modulated data into a data voltage and supplying the data voltage to the pixels.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION

Hereinafter, an implementation of this document will be described in detail with reference to FIGS. 3 to 17.

Figure 1:
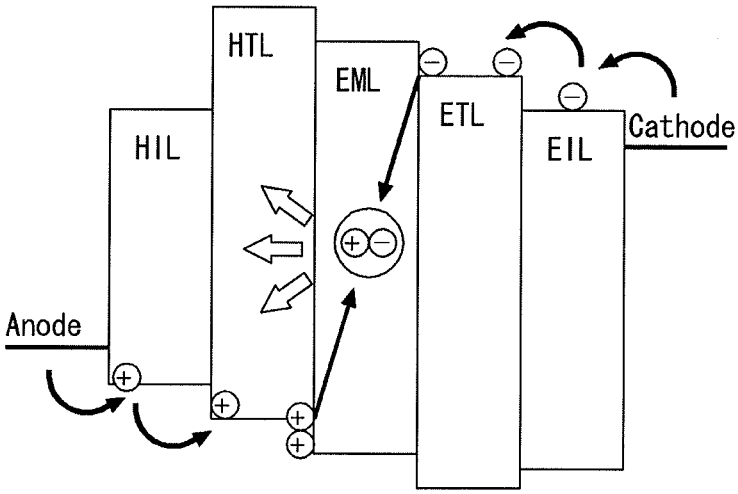
FIG. 1 (RELATED ART)
FIG. 1 is a view showing the principle of light emission of a general organic light emitting diode display.
Figure 2:
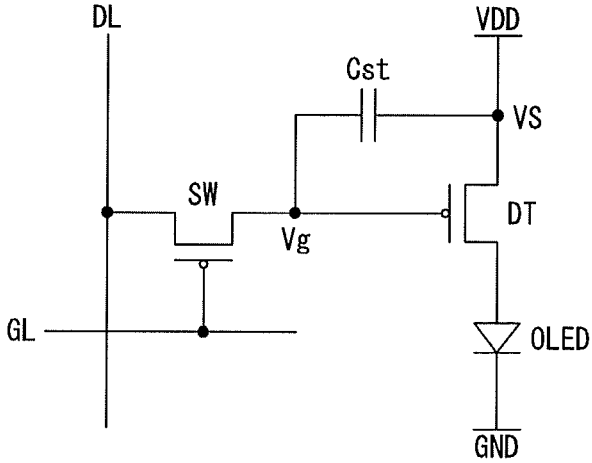
FIG. 2 (RELATED ART)
FIG. 2 is a view equivalently showing one pixel in a conventional organic light emitting diode display having a 2T1C structure.
Figure 3:
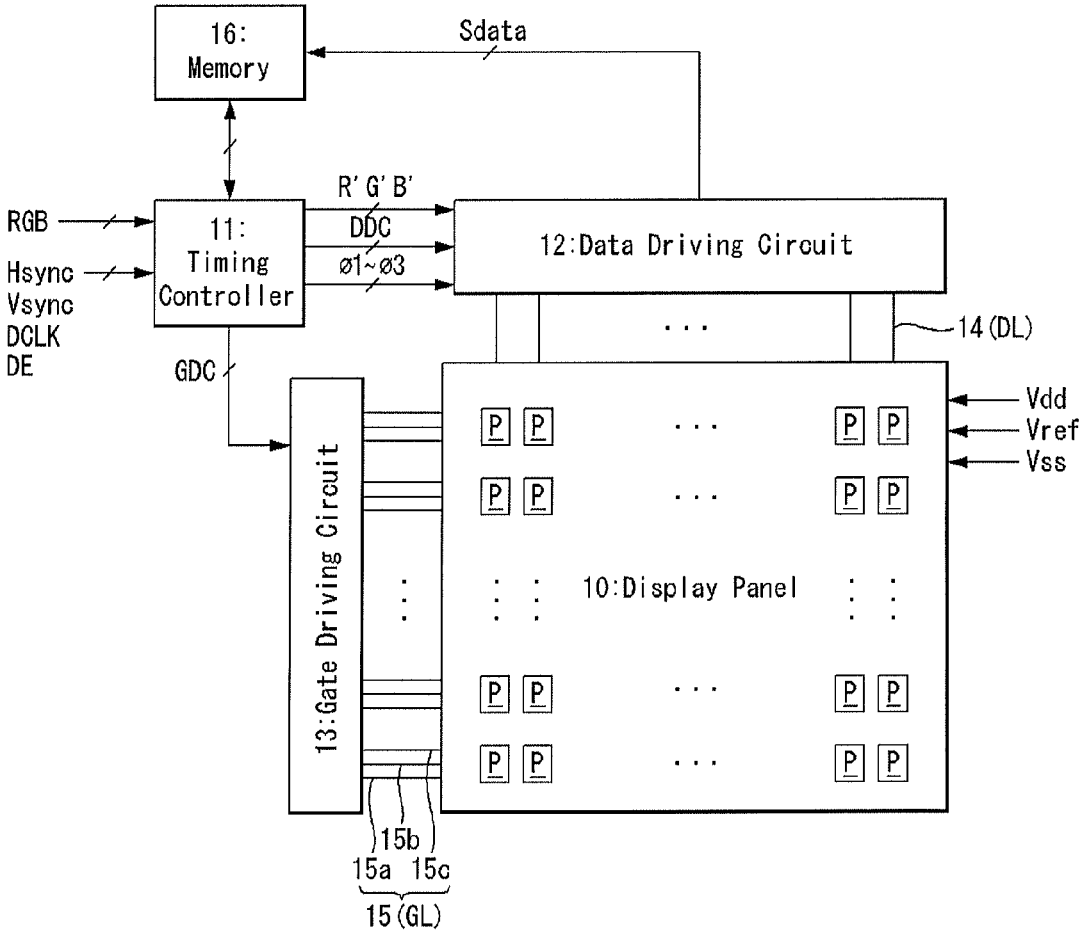
FIG. 3 is a view showing an organic light emitting diode display according to an exemplary embodiment of the present invention.
Figure 4:
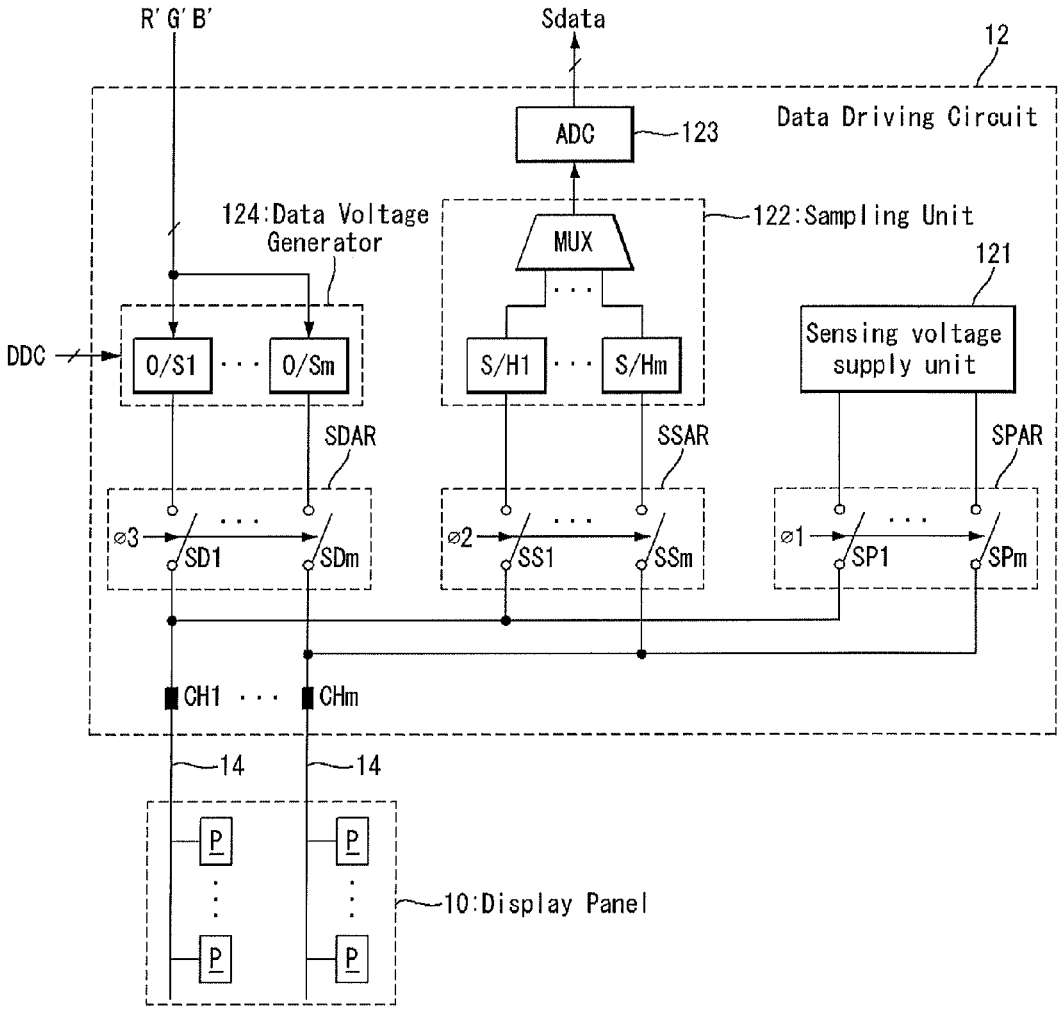
FIG. 4 is a view showing in detail a data driving circuit of FIG. 3.

FIG. 3 is a view showing an organic light emitting diode display according to an exemplary embodiment of the present invention. FIG. 4 is a view showing in detail a data driving circuit of FIG. 3.

Referring to FIGS. 3 and 4, the organic light emitting diode display according to the exemplary embodiment of the present invention comprises a display panel 10 having pixels P arranged in a matrix, a data driving circuit 12 for driving data line portions 14, a gate driving circuit 13 for driving gate line portions 15, a timing controller for controlling the driving timings of the data driving circuit 12 and the gate driving circuit 13, and a memory 16.

Figure 5:
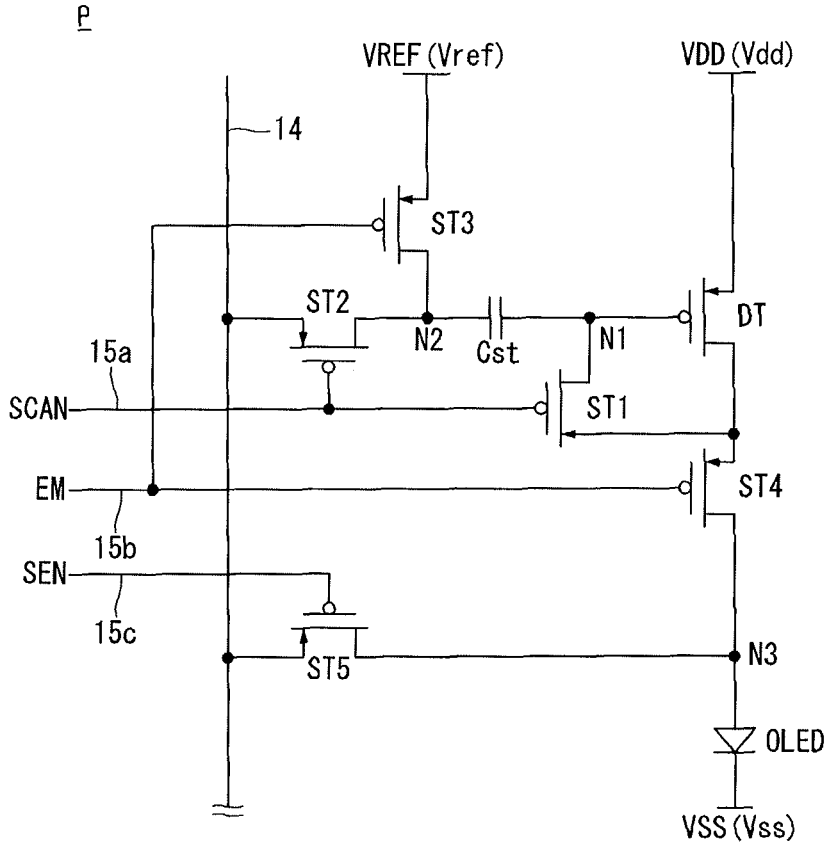
FIG. 5 is a view showing one example of a pixel P to which a first compensation scheme is applied.
Figure 11:
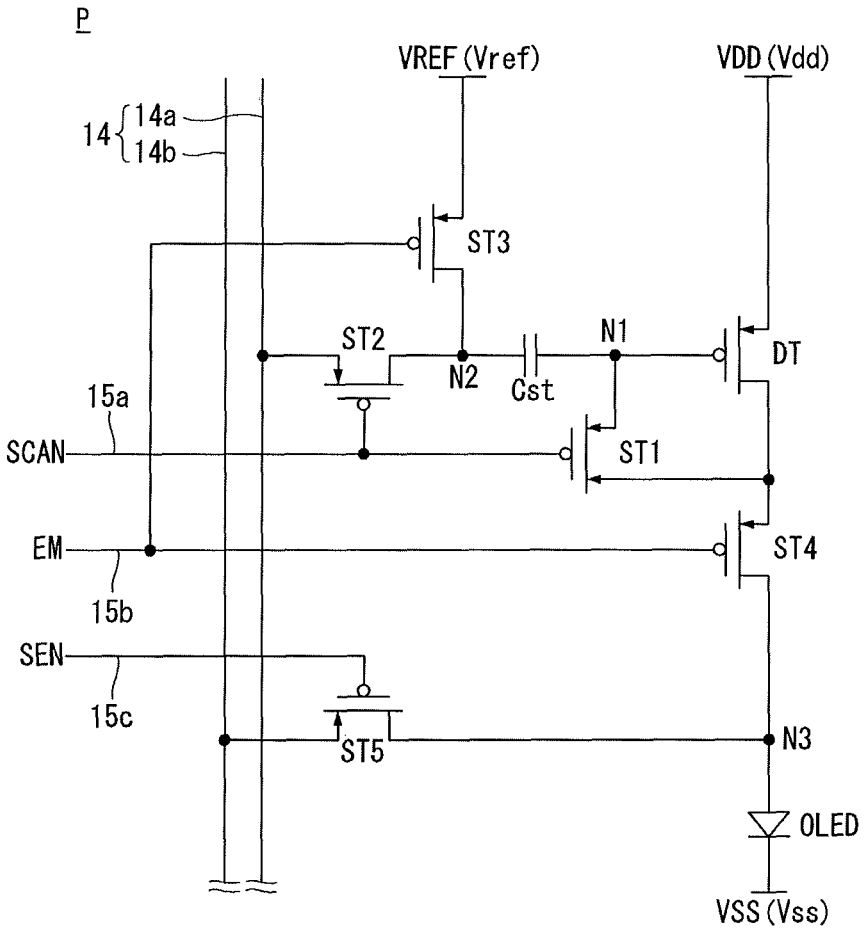
FIG. 11 shows another example of a pixel P to which the first compensation scheme is applied.
Figure 12:
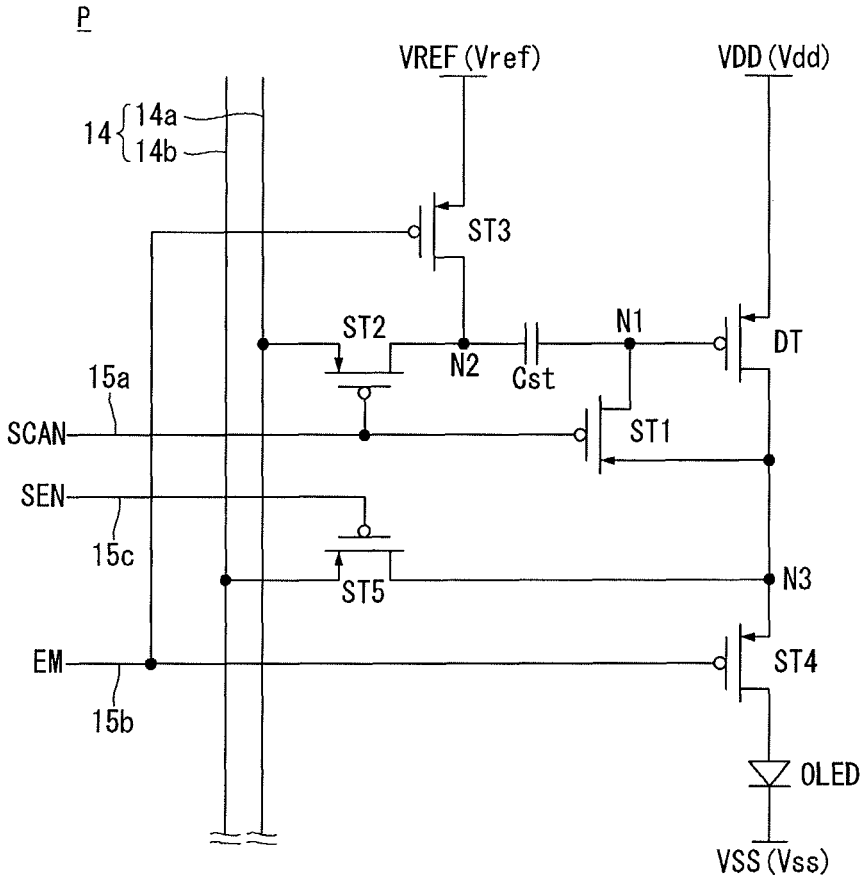
FIG. 12 shows another example of a pixel P to which the first compensation scheme is applied.
Figure 13:
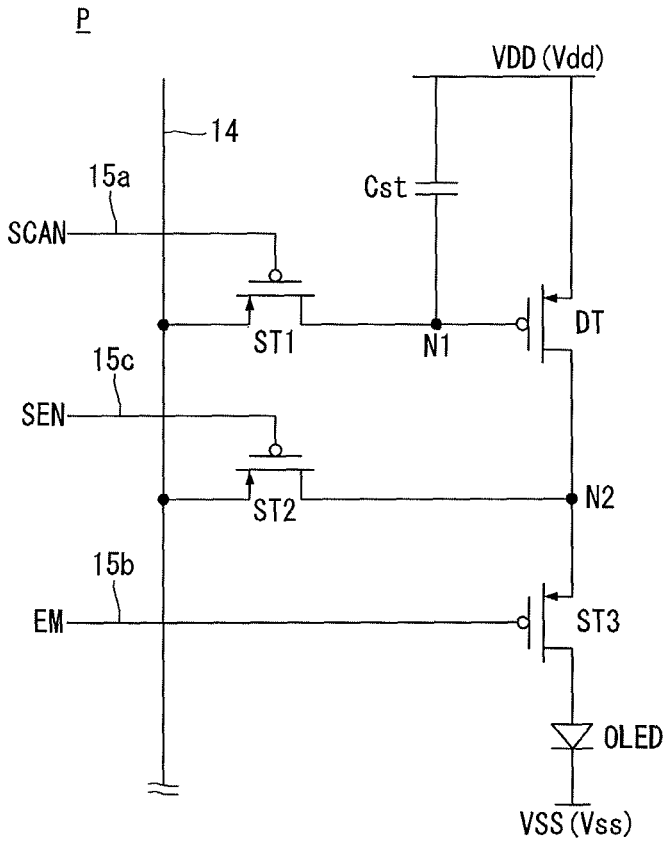
FIG. 13 is a view showing one example of a pixel P to which the first compensation scheme is applied.
Figure 17:
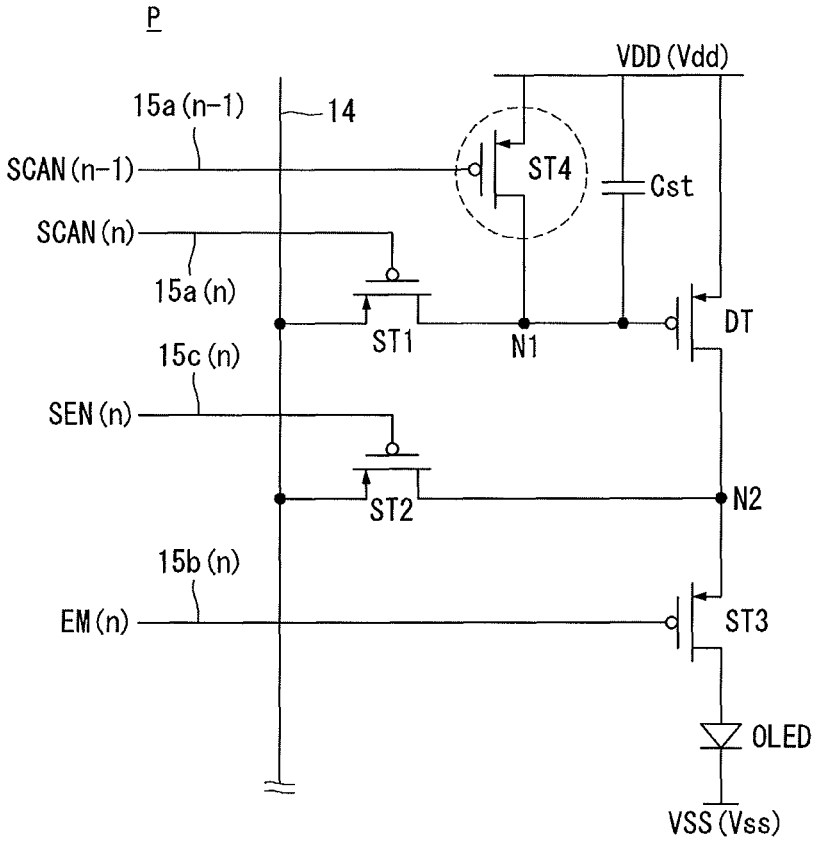
FIG. 17 is a view showing another example of a pixel P to which the second compensation scheme is applied.

In the display panel 10, a plurality of data line portions 14 and a plurality of gate line portions 15 intersect each other, and each of the intersections has the pixels P arranged in a matrix. Each of the data line portions 14 may comprise only a data line, or may comprise a data line and a sensing line. Each of the gate line portions 15 comprises a scan pulse supply line 15A, an emission pulse supply line 15B, and a sensing pulse supply line 15C. Each pixel P is connected to the data driving circuit 12 via the data line portions 14, and connected to the gate driving circuit 13 via the gate line portions 15. Each pixel P is commonly supplied with a high potential driving voltage Vdd, a low potential driving voltage Vss, and a reference voltage Vref. The high potential driving voltage Vdd is generated at a predetermined level by a high potential voltage source, and the low potential driving voltage is generated at a predetermined level by a low potential voltage source, and the reference voltage Vref is generated at a predetermined level by a reference voltage source. The reference voltage Vref is set to a voltage level between the low potential voltage Vss and the high potential driving voltage Vdd, preferably, a voltage level lower than the threshold voltage of the organic light emitting diode. Each pixel P comprises an organic light emitting diode, a driving TFT, and a plurality of switching TFTs. The configuration of the pixel P can be varied according to a compensation scheme. For example, the pixel P may have the configuration as shown in FIGS. 5, 11, and 12 corresponding to a scheme for compensating for a difference in the deterioration of the driving TFTs during normal driving and compensating for a difference in the deterioration of the organic light emitting diodes during compensation driving which is separately carried out from the normal driving. The pixel P may have the configuration as shown in FIGS. 13 and 17 corresponding to a scheme for compensating both the difference in the deterioration of the organic light emitting diodes and the difference in the deterioration of the driving TFTs.

The timing controller 11 generates a data control signal DDC for controlling the operation timing of the data driving circuit 12, switch control signals ϕ 1 to ϕ 3 for controlling switch arrays SDAR, SSAR, and SPAR in the data driving circuit 12, and a gate control signal GDC for controlling the operation timing of the gate driving circuit 13 based on timing signals such as a vertical synchronization signal Vsync, a horizontal synchronization signal Hsync, a dot clock signal DCLK, and a data enable signal DE that are input from a system board (not shown).

The timing controller 11 modulates digital video data RGB input from a system board based on compensation data Sdata stored in the memory 16. Then, the timing controller 11 supplies modulated digital data R'G'B' to the data driving circuit 12.

Figure 6:
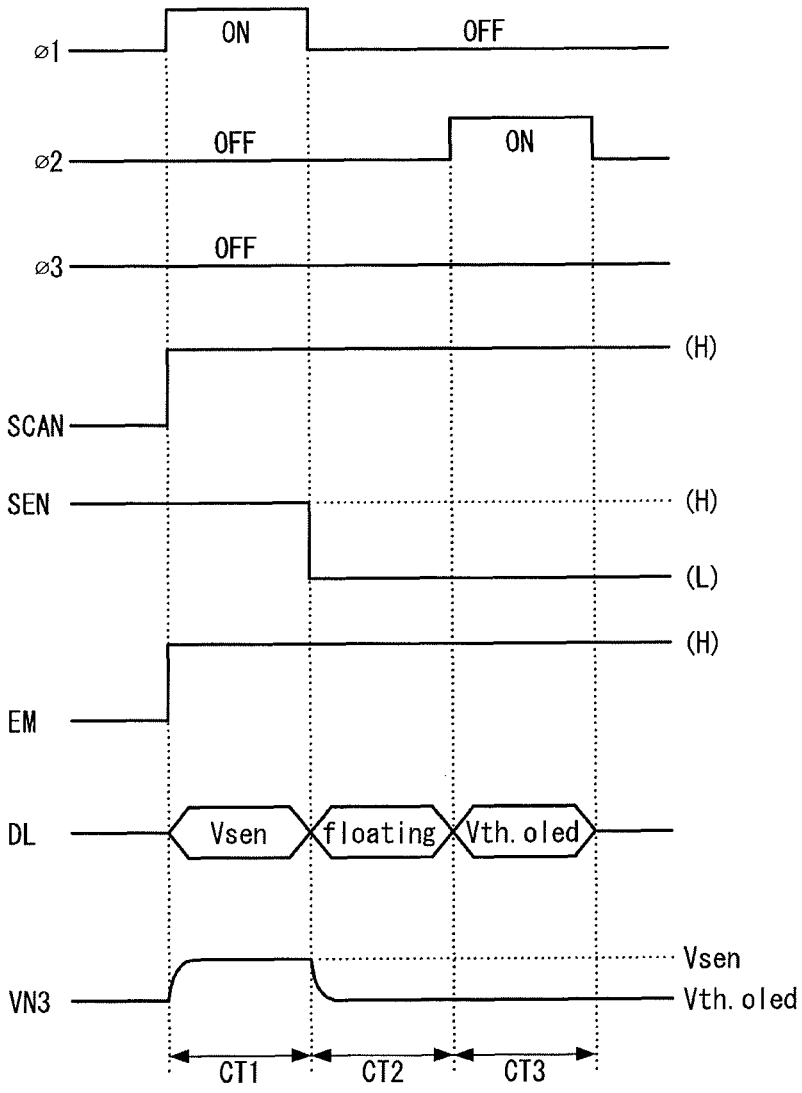
FIG. 6 is a diagram showing the waveform of application of control signals for compensation driving.
Figure 7A:
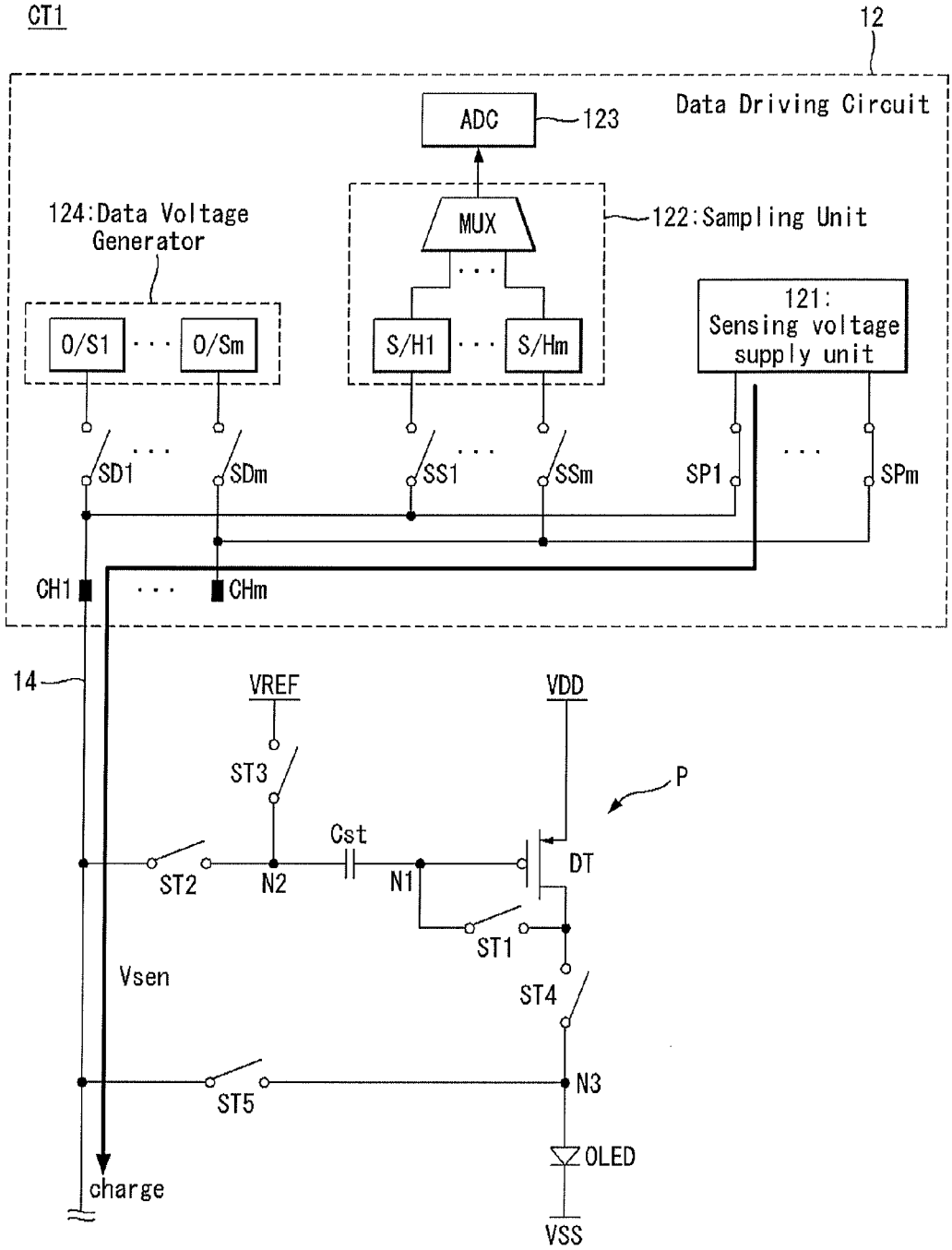
FIGS. 7A to 7C are views sequentially showing operating states of the display device during compensation driving.
Figure 7B:
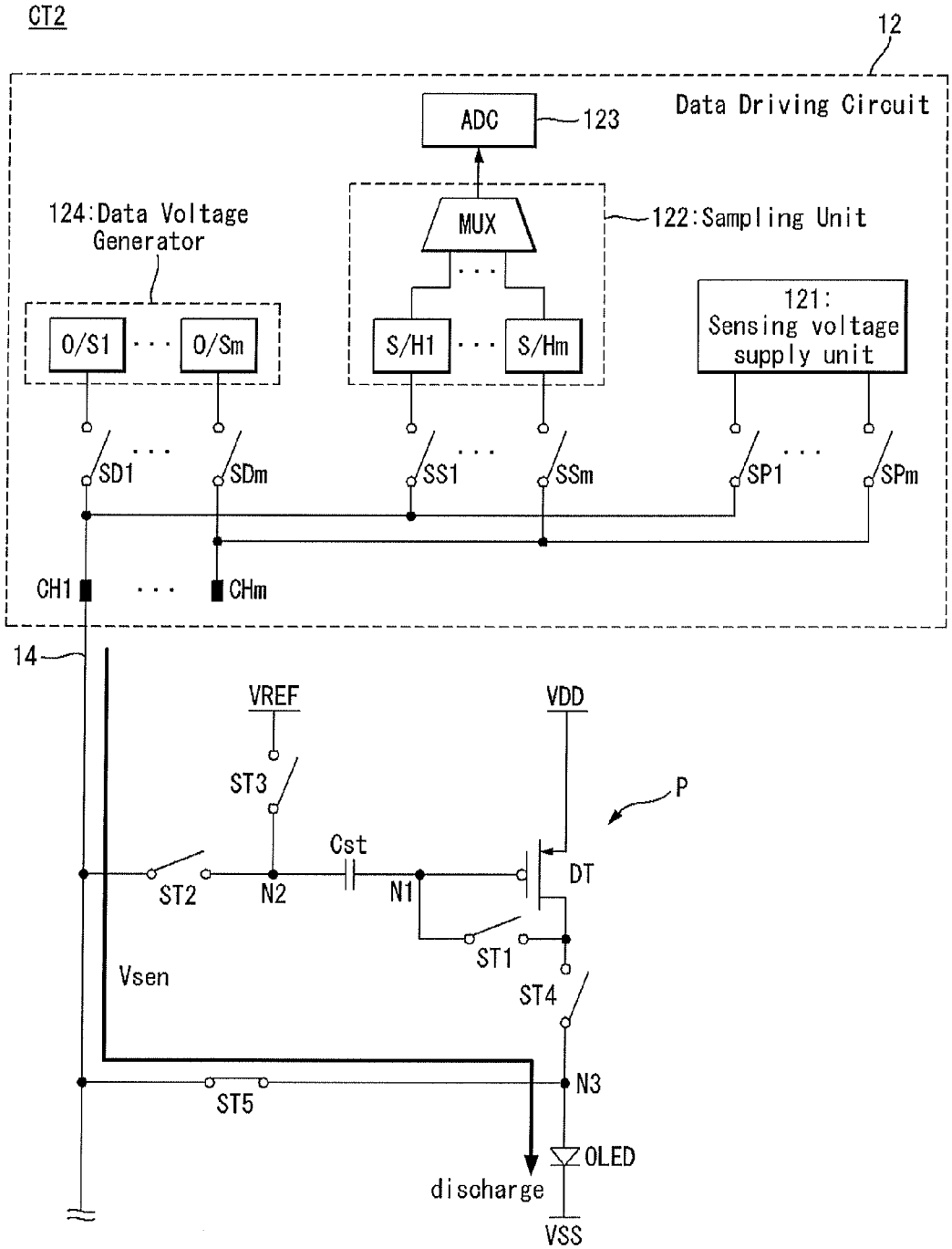
Figure 7C:
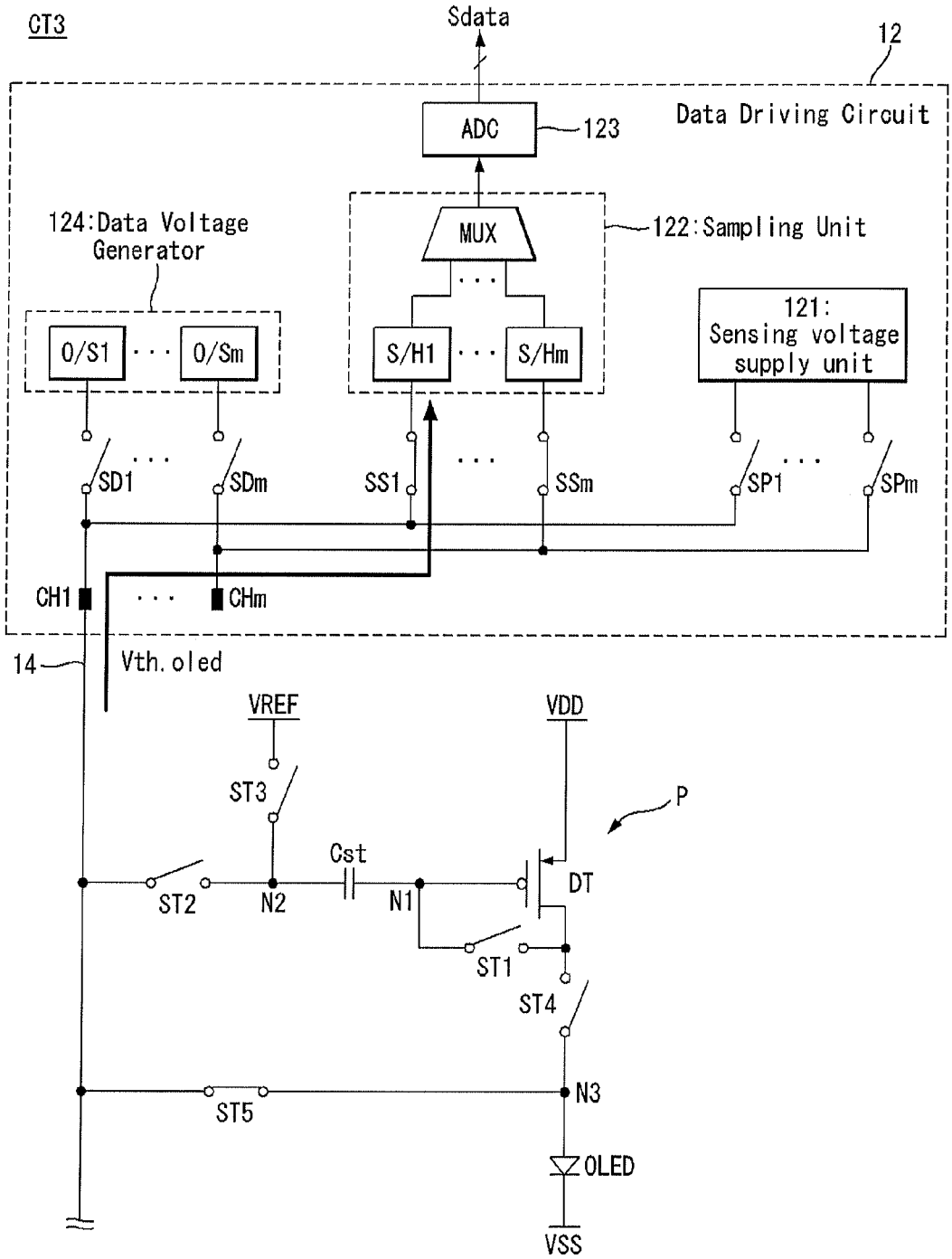

The data driving circuit 12 senses the deterioration degrees of the organic light emitting diodes of the pixels P under control of the timing controller 11 during compensation driving, and supplies a sensing result, as compensation data Sdata, to the memory 16 (see FIGS. 6 to 7C). Moreover, the data driving circuit 12 senses the deterioration degrees of the organic light emitting diodes of the pixels P under control of the timing controller 11 during compensation driving, and supplies a sensing result as compensation data Sdata to the memory 16 (see FIGS. 14 and 15G). To this end, the data driving circuit 12 is provided with a sensing voltage supply unit 121, a sampling unit 122, an analog-digital converter (hereinafter, "ADC") 123, a first switch array SPAR, and a second switch array SSAR. Reference numerals CH1 to CHm indicate output channels of the data driving circuit 12.

The sensing voltage supply unit 121 generates a sensing voltage for sensing the deterioration degree of the organic light emitting diode, or a first sensing voltage for sensing the deterioration degree of the organic light emitting diode and a second sensing voltage for sensing the deterioration degree of the driving TFT. Moreover, the sensing voltage supply unit 121 may generate a high potential driving voltage in some cases. The first switch array SPAR comprises a plurality of switches SP1 to SPm to be switched in response to a first switch control signal ϕ 1, and supplies the sensing voltages generated by the sensing voltage supply unit 121 to each data line portion 14 of the display panel 10 through the output channels CH1 to CHm.

The sampling unit 122 samples a threshold voltage value depending on the deterioration degree of the organic light emitting diode, or a threshold voltage value depending on the deterioration degree of the organic light emitting diode and a threshold voltage value depending on the deterioration degree of the driving TFT, which are fed back from each data line portion 14. The sampling unit 122 may comprise a plurality of sampling & hold blocks S/H1 to S/Hm and a multiplexer MUX for sequentially outputting input values from the sampling & hold blocks S/H1 to S/Hm. The second switch array SSAR comprises a plurality of switches SS1 to SSm to be switched in response to a second switch control signal ϕ 2, and supplies the threshold voltage values fed back from each data line portion 14 of the display panel 10 to the sampling unit 122 via the output channels CH1 to CHm.

The ADC 123 converts analog values input from the sampling unit 122, and then supplies them as compensation data Sdata to the memory 16. The ADC 123 may be realized in one or plural units.

During normal driving, the data driving circuit 12 converts the modulated digital data R'G'B' into an analog data voltage (hereinafter, "data voltage") under control of the timing controller 11 and supplies it to the data line portions 14. To this end, the data driving circuit 12 comprises a data voltage generator 124 and a third switch array SDAR.

The data voltage generator 124 comprises a plurality of output stages O/S1 to O/S operating in response to a data control signal DDC, and converts the modulated digital data R'G'B' into a data voltage. Each of the output stages O/S1 to O/Sm may comprise a digital-analog converter DAC and an output buffer. The third switch array SDAR comprises a plurality of switches SD1 to SDm to be switched in response to a third switch control signal ϕ 3, and supplies the data voltage from the data voltage generator 124 to each data line portion 14 of the display panel 10 via the output channels CH1 to CHm.

The gate driving circuit 13 comprises a shift register and a level shifter, and generates a scan pulse SCAN, a sensing pulse SEN, and an emission pulse EM under control of the timing controller 11. The scan pulse SCAN is applied to the scan pulse supply line 15A, the emission pulse EM is applied to the emission pulse supply line 15B, and the sensing pulse SEN is applied to the sensing pulse supply line 15C. The shift register array constituting the gate driving circuit 13 may be directly formed on the display panel 10 in a Gate In Panel (GIP) type.

The memory 16 comprises at least one lookup table, and stores compensation data Sdata input from the data driving circuit 12.

Such an organic light emitting diode display compensates for a difference in the deterioration of the organic light emitting diodes and a difference in the deterioration of the driving TFTs mostly by two compensation schemes. According to the first compensation scheme, the difference in the deterioration of the driving TFTs is compensated (internally compensated) for during normal driving, and the difference in the deterioration of the organic light emitting diodes is compensated (internally compensated) fro during compensation driving which is carried out separately from the normal driving. According to the second compensation scheme, both of the difference in the deterioration of the organic light emitting diodes and the difference in the deterioration of the driving TFTs are compensated during the compensation driving which is carried out separately from the normal driving. Hereinafter, the first and second compensation schemes will be sequentially explained.

[First Compensation Scheme]

In a first compensation scheme according to an exemplary embodiment of the present invention, a difference in the deterioration of the organic light emitting diodes is compensated for during compensation driving which is carried out separately from normal driving, and a difference in the deterioration of the driving TFTs is compensated for during normal driving.

FIG. 5 shows one example of a pixel P to which the first compensation scheme is applied. The data line portion 14 connected to this pixel P comprises only a data line.

Referring to FIG. 5, the pixel P comprises an organic light emitting diode OLED, a driving TFT DT, a plurality of switching TFTs ST1 to ST5, and a storage capacitor Cst. The driving TFT DT and the switching TFTs St1 to ST5 may be realized by a P-type MOSFET.

The organic light emitting diode OLED is connected between a third node N3 and a low potential voltage source VSS, and emits light by a current flowing between a high potential voltage source VDD and the low potential voltage source VSS.

The driving TFT DT is connected between the high potential voltage source VDD and the third node N3, and controls the amount of current flowing in the organic light emitting diode OLED according to a voltage between the source and gate of the driving TFT DT, i.e., a voltage applied between the high potential voltage source VDD and a first node N1.

The first switching TFT ST1 is connected between the first node N1 and a drain terminal of the driving TFT DT, and is switched in response to a scan pulse SCAN from the scan pulse supply line 15A. The second switching TFT ST2 is connected between the data line 14 and a second node N2, and is switched in response to the scan pulse SCAN from the scan pulse supply line 15A. The third switching TFT ST3 is connected between the reference voltage source VREF and the second node N2, and is switched in response to an emission pulse EM from the emission pulse supply line 15B. The fourth switching TFT ST4 is connected between the driving TFT DT and the third node N3, and switched in response to the emission pulse EM from the emission pulse supply line 15B. The fifth switching TFT ST5 is connected between the data line 14 and the third node N3, and switched in response to a sensing pulse SEN from the sensing pulse supply line 15C.

The storage capacitor Cst is connected between the first node N1 and the second node N2.

The organic light emitting diode having such a pixel P structure operates in a compensation driving mode and in a normal driving mode. The compensation driving refers to driving for sampling the threshold voltage of the organic light emitting diode OLED in order to derive compensation data Sdata depending on the deterioration degree of the organic light emitting diode. The normal driving refers to driving for applying modulated digital data R'G'B', to which the compensation data Sdata is reflected, while internally compensating for the deterioration degree of the driving TFT DT.

Hereinafter, a circuit operation during compensation driving and a circuit operation during normal driving under the pixel P structure will be sequentially described.

FIG. 6 is a waveform diagram of application of control signals for compensation driving. FIGS. 7A to 7C sequentially show operating states of the display device during compensation driving.

The compensation driving is sequentially performed during a first period CT1 for charging the data line 14 with a sensing voltage Vsen, a second period CT2 for floating the data line 14 and then discharging the sensing voltage Vsen on the data line 14 via the organic light emitting diode OLED, and a third period CT3 for sampling the sensing voltage Vsen remaining on the data line 14 after discharging as the threshold voltage Vth.oled of the organic light emitting diode OLED. The compensation driving can be performed all the pixels P during at least one frame to be synchronized with the on timing of a driving power, or during at least one frame to be synchronized with the off timing of the driving power. Moreover, the compensation driving can be sequentially performed for the pixels P for one horizontal line every blank period between adjacent frames.

Referring to FIGS. 6 and 7A, during the first period CT1, the scan pulse SCAN, emission pulse EM, and sensing pulse SEN are generated at a high logic level H to turn off the first to fifth switching TFTs ST1 to ST5 of the pixel P. Only the first switch control signal ϕ 1 is generated at a turn-on level during the first period CT1 to turn on the switches SP1 to SPm in the data driving circuit 12. As a result, the data lines 14 are charged rapidly by the sensing voltage Vsen supplied from the sensing voltage supply unit 121. The charging speed of the data line 14 according to this exemplary embodiment is much higher compared to the conventional art in which a current source is placed outside the pixel and the parasitic capacitor of the data line 14 is charged via the current source.

Referring to FIGS. 6 and 7B, during the second period CT2, the scan pulse SCAN and the emission pulse EM are maintained at the high logic level H to continuously turn off the first to fourth switching TFTs ST1 to ST4 of the pixel P, whereas the sensing pulse SEN is inverted to a low logic level L to turn on the fifth switching TFT ST5. During the second period CT2, the first switch control signal ϕ 1 is inverted to a turn-off level to turn off the switches SP1 to SPm in the data driving circuit 12. As a result, the data lines 14 are floated from the data driving circuit 12, and the sensing voltage Vsen charged in the data line 14 is discharged by the low potential voltage source VSS until it has a potential equivalent to the threshold voltage Vth.oled of the organic light emitting diode OLED.

Referring to FIGS. 6 and 7C, during the third period CT3, the scan pulse SCAN and the emission pulse EM are maintained at the high logic level H to continuously turn off the first to fourth switching TFTs ST1 to ST4 of the pixel P, and the sensing pulse SEN is maintained at the low logic level L to continuously turn on the fifth switching TFT ST5 of the pixel P. During the third period CT3, only the second switch control signal ϕ2 is generated at the turn-on level to turn on the switches SS1 to SSm in the data driving circuit 12. As a result, the threshold voltage Vth.oled of the organic light emitting diode OLED remaining in the data line 14 is sampled by the sampling unit 122, then passes through the ADC 123, and is converted into compensation data Sdata.

Figure 8:
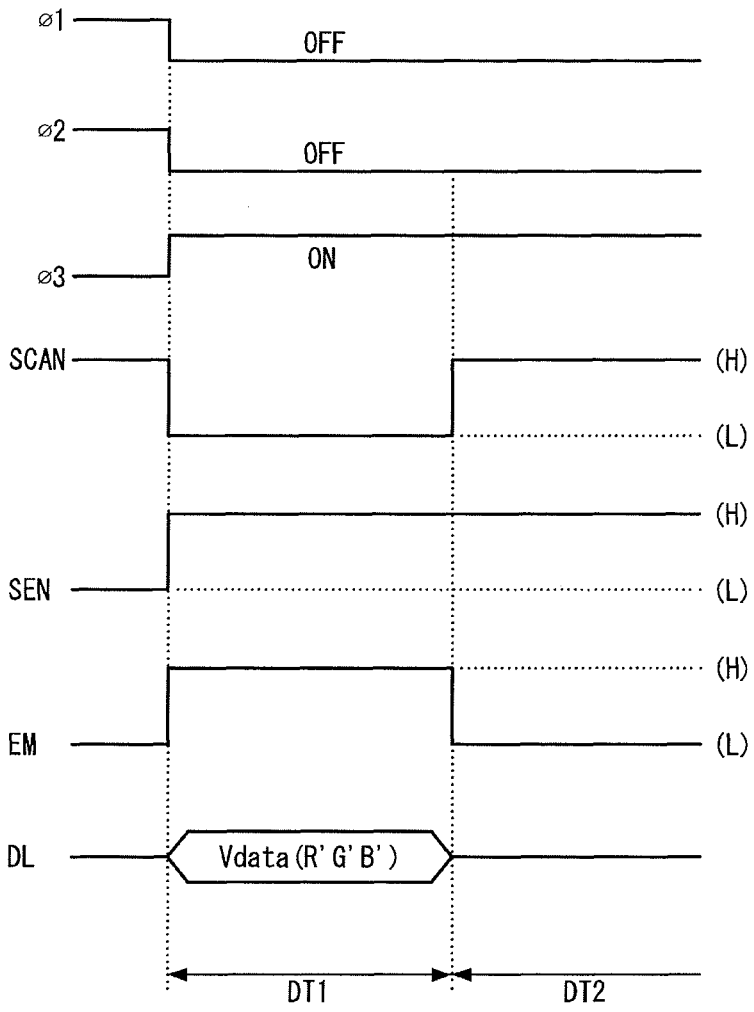
FIG. 8 is a diagram showing the waveform of application of control signals for normal driving.
Figure 9A:
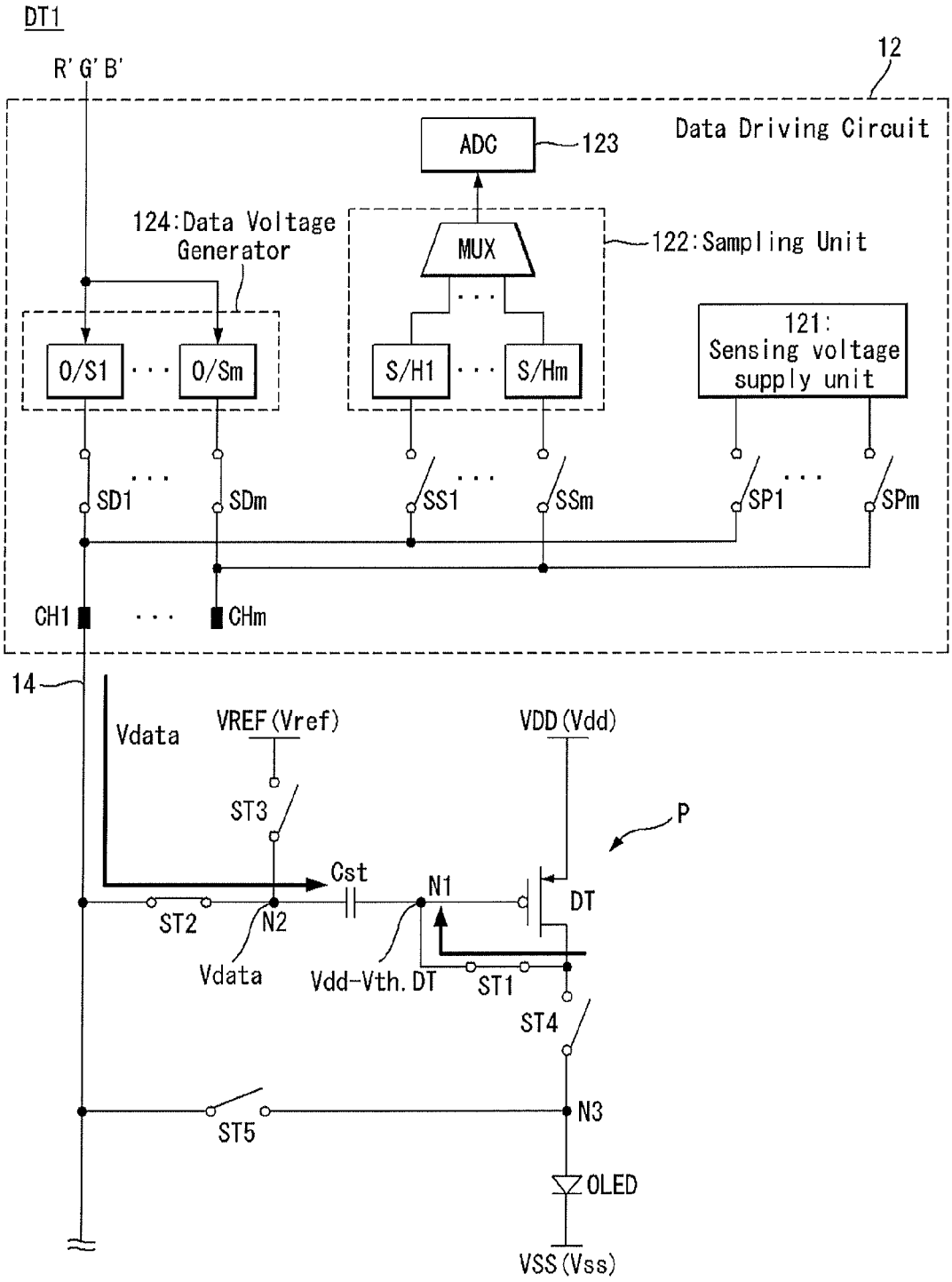
FIGS. 9A and 9B are views sequentially showing operating states of the display device during normal driving.
Figure 9B:
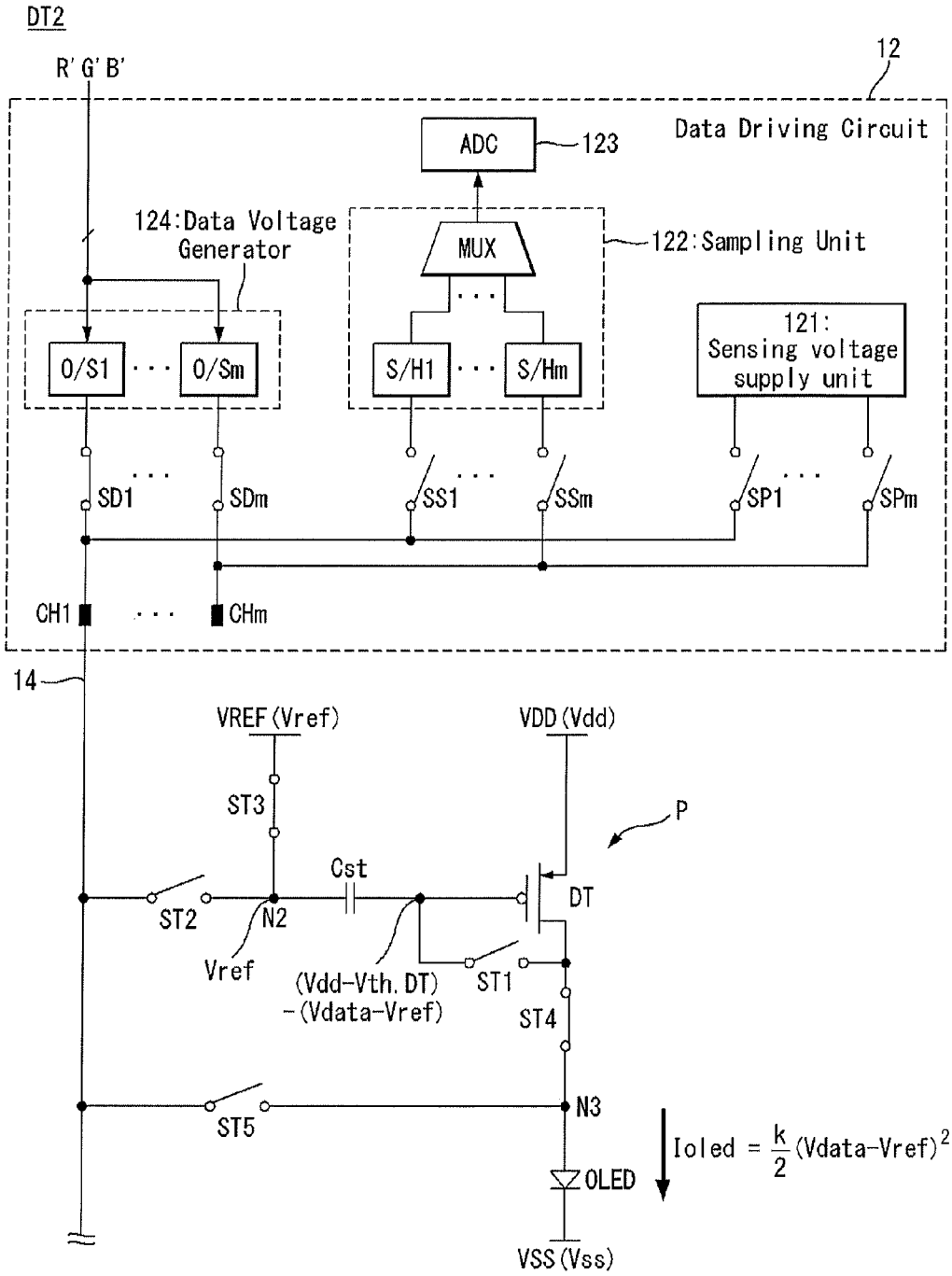

FIG. 8 is a waveform diagram of application of control signals for normal driving. FIGS. 9A and 9B sequentially show operating states of the display device during normal driving.

The normal driving is sequentially performed for a first period DT1 for sensing a difference in the deterioration of the driving TFTs DT and a second period DT2 for light emission.

Referring to FIGS. 8 and 9A, during a first period DT1, a scan pulse SCAN is generated at a low logic level L to turn on the first and second TFTs ST1 and ST2 of the pixel P, an emission pulse EM is generated at a high logic level H to turn off the third and fourth switching TFTs ST3 and ST4 of the pixel P, and a sensing pulse SEN is generated at the high logic level H to turn off the fifth switching TFT ST5 of the pixel P. During the first period DT1, only the third switch control signal ϕ 3 is generated at a turn-on level to turn on the switches SD1 to SDm in the data driving circuit 12. As a result, the data voltage generator 124 converts modulated digital video data R'G'B' into a data voltage Vdata and supplies it to the data line 14. The difference in the deterioration of the organic light emitting diodes OLEDs is reflected in the data voltage Vdata. The data voltage Vdata is applied to the second node N2 of the pixel P. In the pixel P, an intermediate compensation value Vdd−Vth·DT is applied to the first node 1 by a diode connection of the driving TFT DT (short between the gate and drain electrodes of the driving TFT DT). The intermediate compensation value Vdd−Vth·DT is for compensating for the difference in the deterioration of the driving TFTs DT, which is determined by subtracting the threshold voltage Vth·DT of the driving TFT DT from the high potential driving voltage Vdd. The storage capacitor Cst maintains the potential of the first node N1 at the intermediate compensation value Vdd−Vth·DT, and maintains the potential of the second node N2 at the data voltage Vdata.

Referring to FIGS. 8 and 9B, during the second period DT2, the scan pulse SCAN is inverted to the high logic level H to turn off the first and second switching TFTs ST1 and ST2 of the pixel P, the emission pulse EM is inverted to the low logic level L to turn on the third and fourth switching TFTs ST3 and ST4 of the pixel, and the sensing pulse SEN is maintained at the high logic level H to continuously turn off the fifth switch TFT ST5 of the pixel P. During the second period DT2, the third switch control signal ϕ 3 is maintained at the turn-on level to continuously turn on the switches SD1 to SDM in the data driving circuit 12. As a result, a reference voltage Vref is applied to the second node N2 of the pixel P, and the potential of the second node N2 changes from the data voltage Vdata to the reference voltage Vref. As the first node N1 is connected to the second node N2 with the storage capacitor Cst interposed therebetween, the potential change Vdata−Vref of the second node is reflected as it is in the potential of the first node N1. As a result, the potential of the first node N1 changes to a final compensation value {(Vdd−Vth·DT)−(Vdata−Vref)} obtained by subtracting the potential change Vdata−Vref of the second node from the intermediate compensation value Vdd−Vth·DT. The final compensation value {(Vdd−Vth·DT)−(Vdata−Vref)} is for compensating for a difference in the deterioration of the driving TFTs DT.

At this point, a driving current Ioled flowing in the organic light emitting diode OLED is as shown in the following Equation 1:

[Equation 1]

$$Ioled = \frac{k}{2}(Vsg - Vth \cdot DT)^2 \quad \text{(A)}$$

$$= \frac{k}{2}[Vdd - ((Vdd - Vth \cdot DT) - (Vdata - Vref)) - Vth \cdot DT]^2 \quad \text{(B)}$$

$$= \frac{k}{2}(Vdata - Vref)^2 \quad \text{(C)}$$

where k denotes a constant determined by mobility, parasitic capacitance, and channel length, and Vsg denotes a voltage between the source and gate of the driving TFT DT.

As is easily seen from Equation 1, the driving current Ioled according to the present invention depends on the data voltage Vdata and the reference voltage Vref which can be controlled by a user, and is not affected by the level of the high potential driving voltage Vdd applied to the driving TFT DT as well as the threshold voltage Vth·DT of the driving TFT DT. This means that the difference in the deterioration of the driving TFTs DT and the difference in driving voltage Vdd of the driving TFTs DT are all internally compensated for.

Figure 10:
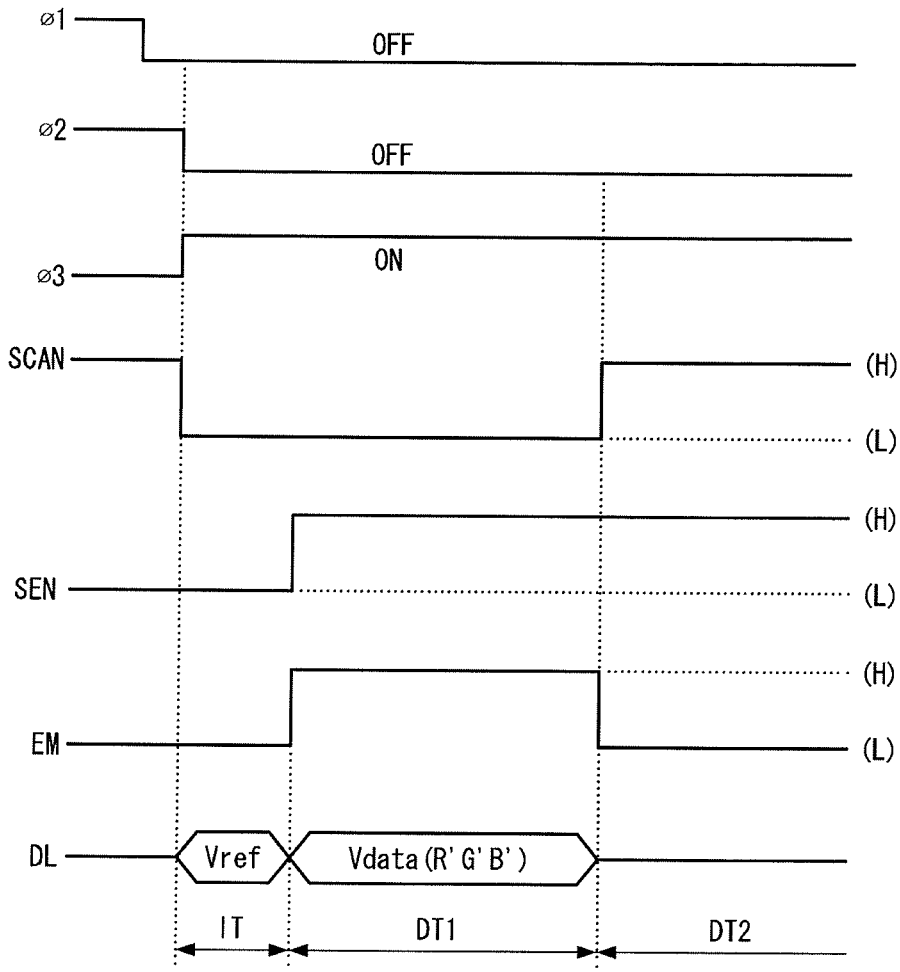
FIG. 10 is a view showing that a normal driving period further comprises an initialization period.

As shown in FIG. 10, a normal driving period may further comprise an initialization period IT for resetting the first to third nodes N1, N2, and N3 prior to the first period DT1. During the initialization period IT, the scan pulse SCAN, emission pulse EM, and sensing pulse SEN are all generated at the low logic level L to turn on the first to fifth switching TFTs ST1 to ST5 of the pixel P. As a result, the first to third nodes N1, N2, and N3 are initialized to the reference voltage Vref. As mentioned above, the reference voltage Vref is lower than the threshold voltage Vth.oled of the organic light emitting diode OLED, and therefore the organic light emitting diode OLED does not emit light during this period IT.

FIG. 11 shows another example of a pixel P to which the first compensation scheme is applied. The data line portion 14 connected to this pixel P further comprises a sensing voltage line 14*b* in addition to the data line 14*a*.

Referring to FIG. 11, the fifth switching TFT ST5 in the pixel P to be switched in response to the sensing pulse SEN from the sensing pulse supply line 15C is connected between the sensing voltage supply line 14*a* and the third node N3. In this manner, by configuring the data lines 14*a* for applying data voltages and the sensing voltage supply line 14*b* for applying sensing voltages separately, the power consumption in the data driving circuit 12 can be greatly reduced compared to FIG. 5 in which both a sensing voltage and a data voltage are supplied via a single data line. The other components of this pixel P except the fifth switching TFT ST5 are substantially identical to those of FIG. 5. The operations of the data driving circuit 12 and the pixel P during compensation driving and the operations of the data driving circuit 12 and the pixel P during normal driving are substantially identical to those in FIGS. 6 to 10.

FIG. 12 shows another example of a pixel P to which the first compensation scheme is applied. The data line portion 14 connected to this pixel P further comprises a sensing voltage line 14*b* in addition to the data line 14*a*.

Referring to FIG. 12, the fifth switching TFT ST5 in the pixel P to be switched in response to the sensing pulse SEN from the sensing pulse supply line 15C is connected between the sensing voltage supply line 14*a* and the third node N3. In this manner, by configuring the data lines 14*a* for applying data voltages and the sensing voltage supply line 14*b* for applying sensing voltages separately, the power consumption in the data driving circuit 12 can be greatly reduced compared to FIG. 5 in which both a sensing voltage and a data voltage are supplied via a single data line. Moreover, the fourth switching TFT ST4 in the pixel P to be switched in response to the emission pulse EM from the emission pulse supply line 15B is connected between the third node N3 and the organic light emitting diode OLED unlike FIG. 5. The other components of this pixel P except the fourth and fifth switching TFTs ST4 and ST5 are substantially identical to those of FIG. 5. The operations of the data driving circuit 12 and the pixel P during compensation driving and the operations of the data driving circuit 12 and the pixel P during normal driving are substantially identical to those in FIGS. 6 to 10.

[Second Compensation Scheme]

In a second compensation scheme according to an exemplary embodiment of the present invention, a difference in the deterioration of the organic light emitting diodes and a difference in the deterioration of the driving TFTs are all compensated for during compensation driving which is carried out separately from normal driving FIG. 13 shows one example of a pixel P to which the first compensation scheme is applied. The data line portion 14 connected to this pixel P comprises only a data line.

Referring to FIG. 13, the pixel P comprises an organic light emitting diode OLED, a driving TFT DT, a plurality of switching TFTs ST1 to ST5, and a storage capacitor Cst. The driving TFT DT and the switching TFTs St1 to ST5 may be realized by a P-type MOSFET.

The organic light emitting diode OLED is connected between a second node N2 and a low potential voltage source VSS, and emits light by a current flowing between a high potential voltage source VDD and the low potential voltage source VSS.

The driving TFT DT is connected between the high potential voltage source VDD and the second node N2, and controls the amount of current flowing through the organic light emitting diode OLED according to a voltage between the source and gate of the driving TFT DT, i.e., a voltage applied between the high potential voltage source VDD and a first node N1.

The first switching TFT ST1 is connected between the data line 14 and the first node N1, and is switched in response to a scan pulse SCAN from the scan pulse supply line 15A. The second switching TFT ST2 is connected between the data line 14 and the second node N2, and is switched in response to a sensing pulse SEN from the sensing pulse supply line 15C. The third switching TFT ST3 is connected between the second node N2 and the organic light emitting diode OLED, and is switched in response to an emission pulse EM from the emission pulse supply line 15B.

The storage capacitor Cst is connected between the high potential voltage source VDD and the first node N1.

The organic light emitting diode having such a pixel P structure operates in a compensation driving mode and in a normal driving mode. The compensation driving refers to driving for sampling the threshold voltage of the organic light emitting diode OLED and the threshold voltage of the driving TFT DT in order to derive compensation data Sdata depending on the deterioration degree of the organic light emitting diode and the deterioration degree of the driving TFT DT. The normal driving refers to driving for applying modulated digital data R'G'B', to which the compensation data Sdata is reflected.

Hereinafter, a circuit operation during compensation driving and a circuit operation during normal driving under the pixel P structure will be sequentially described.

Figure 14:
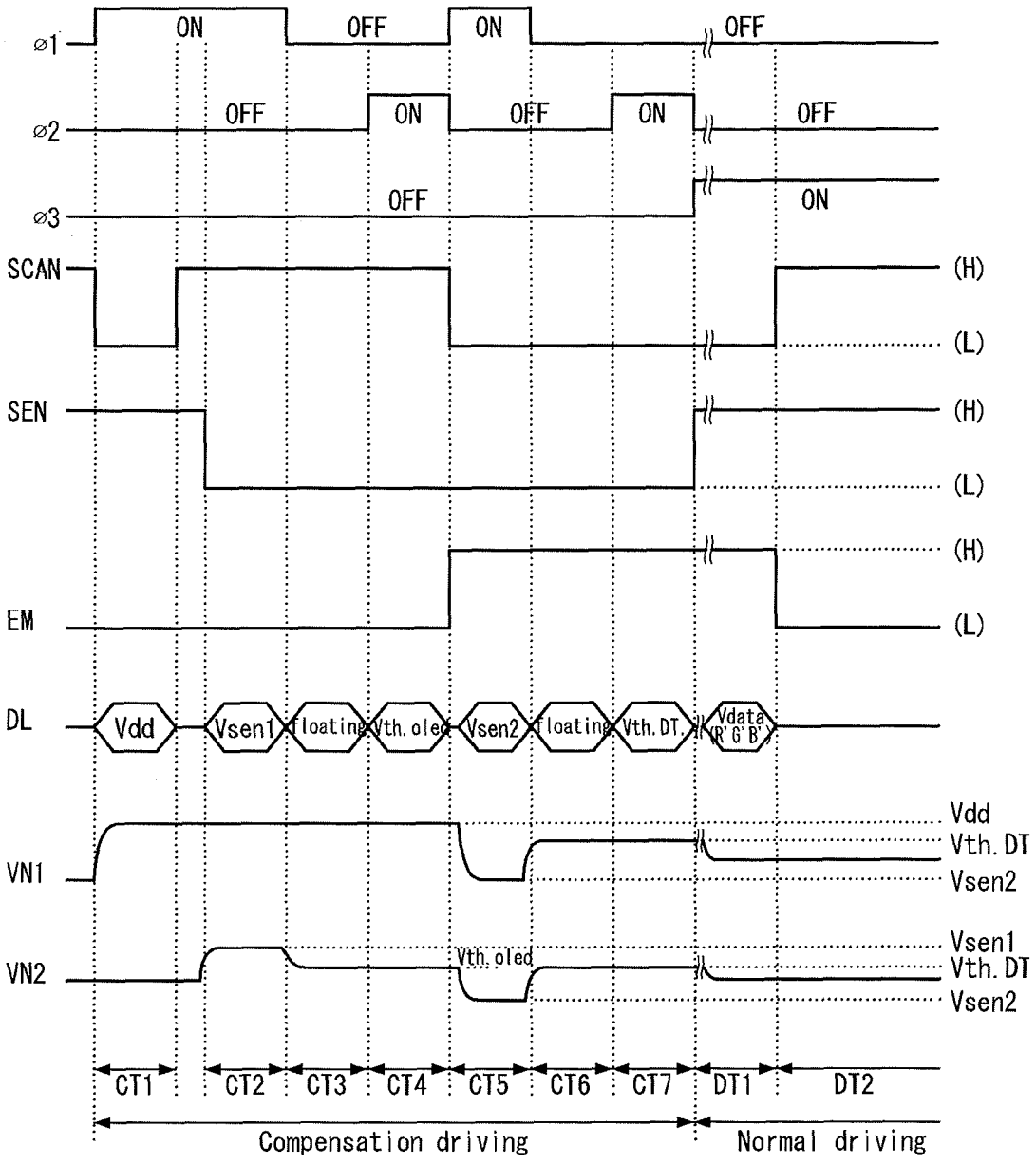
FIG. 14 is a view showing the waveform of application of control signals for compensation driving and normal driving.

FIG. 14 is a waveform diagram of application of control signals for compensation driving and normal driving. FIGS. 15A to 15G sequentially show operating states of the display device during compensation driving. FIGS. 16A and 16B sequentially show operating states of the display device during normal driving.

First of all, the compensation driving is sequentially performed for a first period CT1 for precharging the data line 14 and the first node N1 of the pixel P with a high potential driving voltage Vdd, a second period CT2 for charging the data line 14 with a first sensing voltage Vsen1, a third period CT3 floating the data line 14 and then discharging the first sensing voltage Vsen1 on the data line 14 via the organic light emitting diode OLED, a fourth period CT4 for sampling the first sensing voltage Vsen1 remaining on the data line 14 after discharging as the threshold voltage Vth.oled of the organic light emitting diode OLED, a fourth period CT5 for firstly charging the data line 14 with a second sensing voltage Vsen2, a sixth period CT6 for floating the data line 14 and then secondly charging the data line 14 with the threshold voltage Vth·DT of the driving TFT DT higher than the second sensing voltage Vsen2, and a seventh period CT7 for sampling the threshold voltage Vth·DT of the driving TFT DT on the data line 14. The compensation driving can be performed all the pixels P during at least one frame to be synchronized with the on timing of a driving power, or during at least one frame to be synchronized with the off timing of the driving power. Moreover, the compensation driving can be sequentially performed for the pixels P for one horizontal line every blank period between adjacent frames.

Figure 15A:
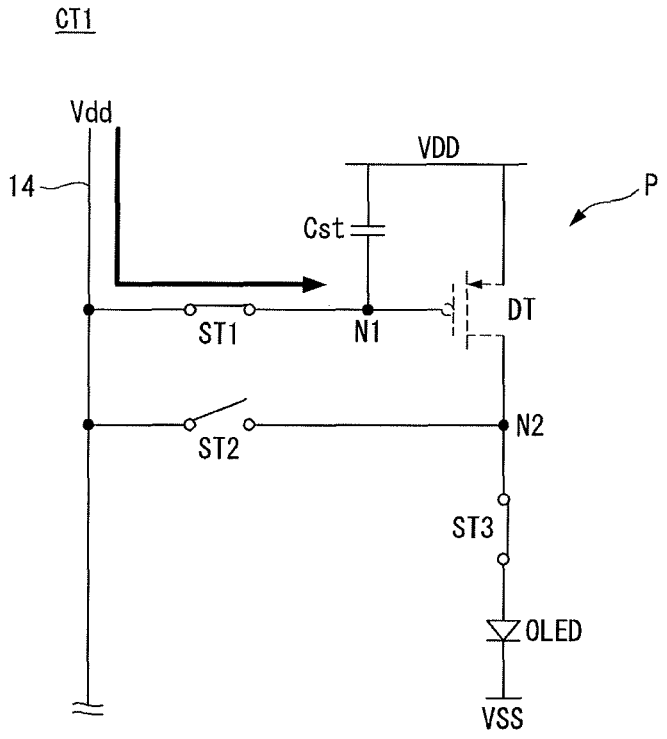
FIGS. 15A to 15G are views sequentially showing operating states of the display device during compensation driving.
Figure 15B:
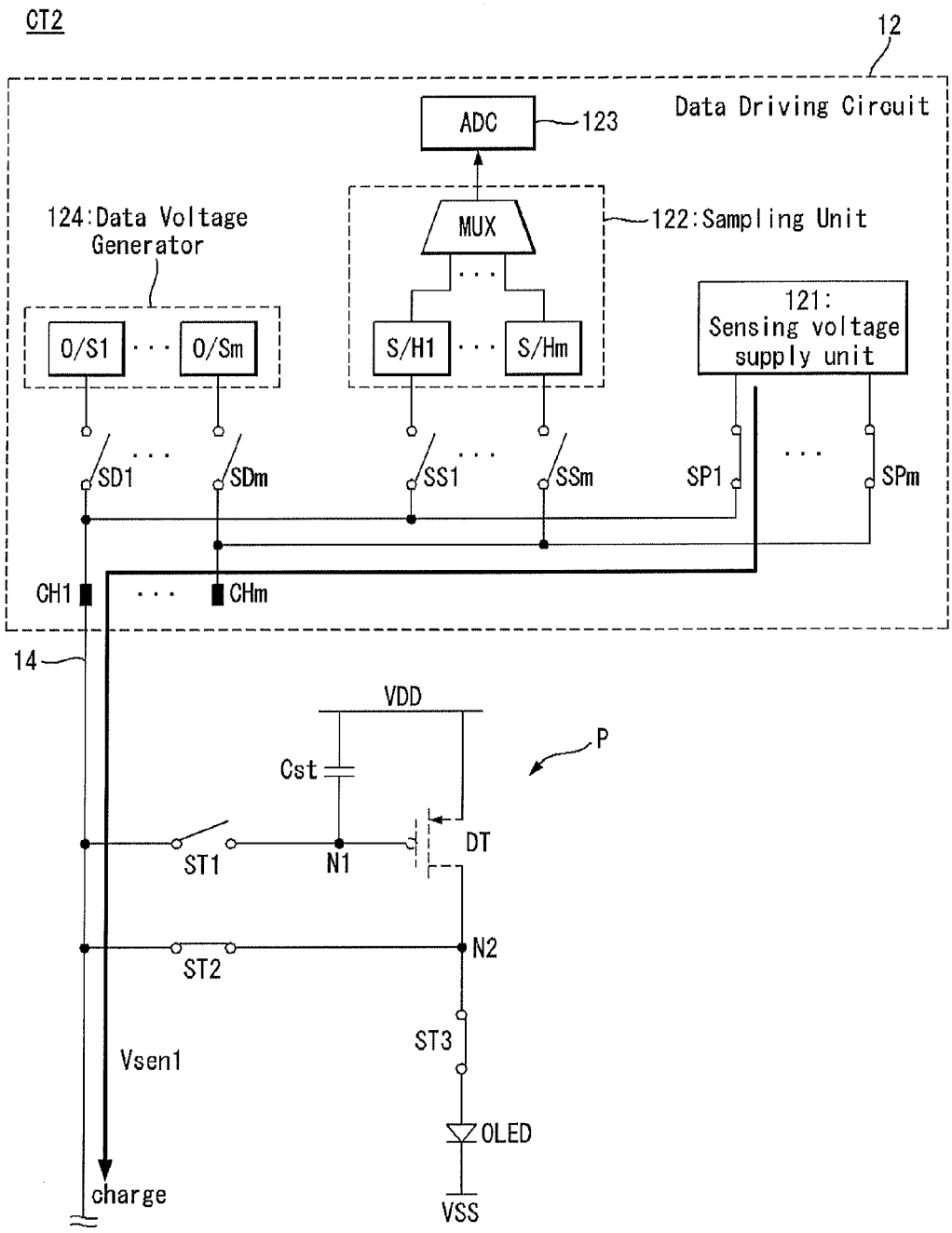
Figure 16A:
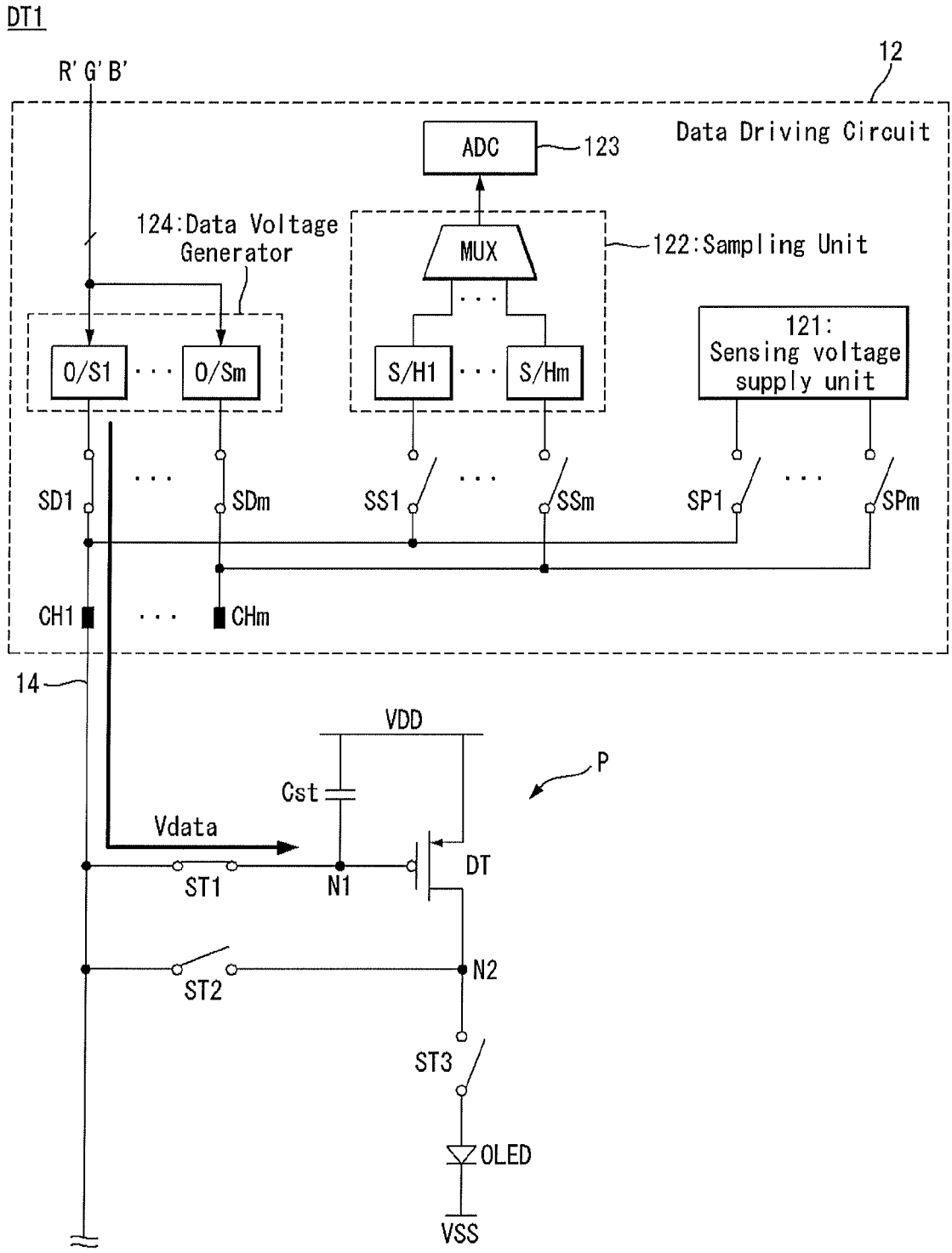
FIGS. 16A and 16B are views sequentially showing operating states of the display device during normal driving.
Figure 16B:
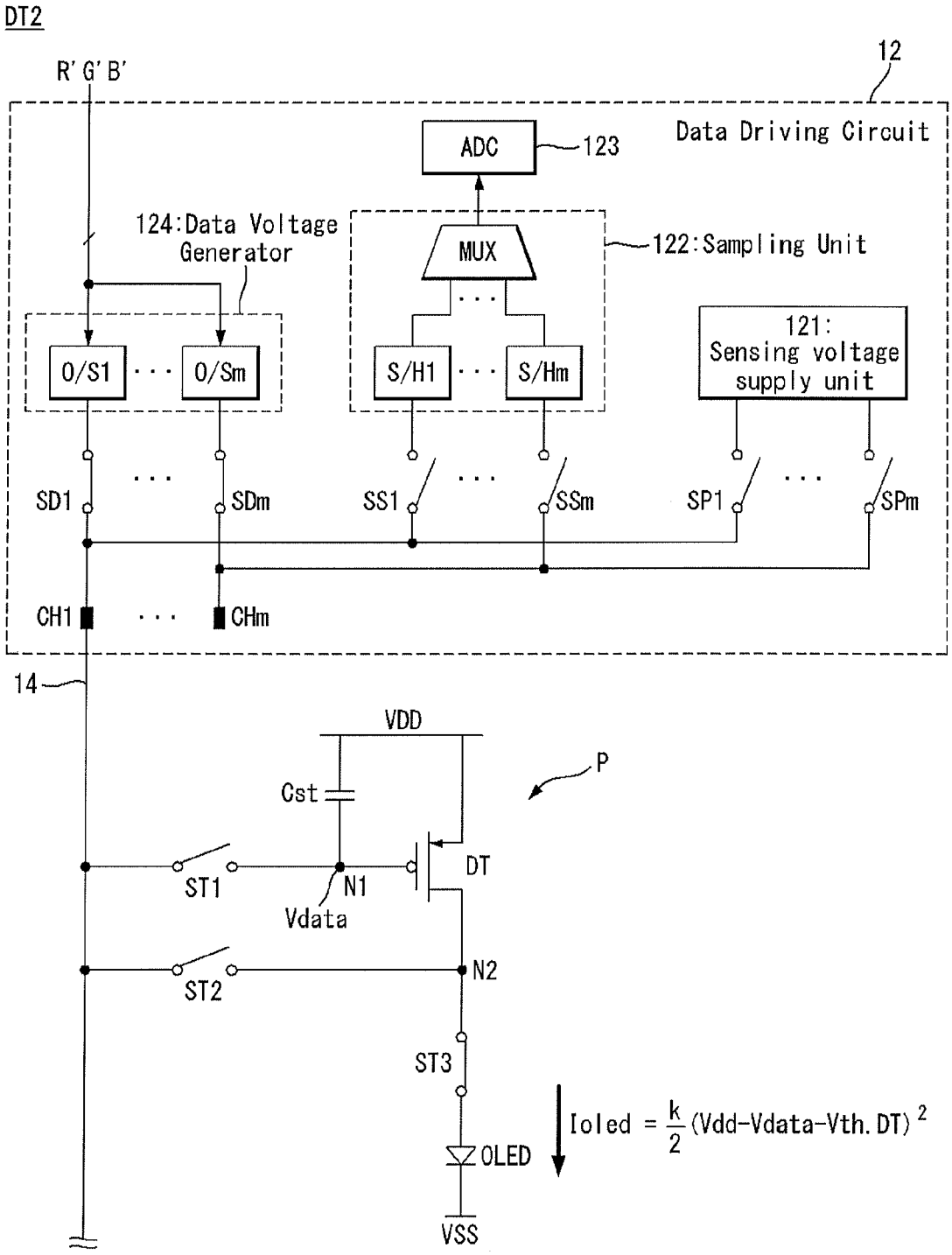

Referring to FIGS. 14 and 15B, during the first period CT1, the scan pulse SCAN and the emission pulse EM are generated at a low logic level L to turn off the first and third switching TFTs ST1 and ST3 of the pixel P, and the sensing pulse SEN is generated at a high logic level H to turn off the second switching TFT ST2 of the pixel P. Only the first switch control signal ϕ 1 is generated at a turn-on level during the first period CT1 to turn on the switches SP1 to SPm in the data driving circuit 12. As a result, the data line 14 and the first node N1 of the pixel P are precharged with the high potential driving voltage Vdd supplied from the sensing voltage supply unit 121. As the potential of the first node N1 is initialized to the high potential driving voltage Vdd, the hysteresis characteristics of the driving TFT DT are greatly improved.

Referring to FIGS. 14 and 153, during the second period CT2, the scan pulse SCAN is inverted to the high logic level H to turn off the first switching TFT ST1 of the pixel P, the emission pulse EM is maintained at the low logic level L to turn on the third switching TFT ST3 of the pixel P, and the sensing pulse SEN is inverted to the low logic level L to turn on the second switching TFT ST2 of the pixel P. During the second period CT2, the first switch control signal ϕ 1 is generated at the turn-on level to turn on the switches SP1 to SPm in the data driving circuit 12. As a result, the data line 14 is rapidly charged with the first sensing voltage Vsen1 supplied from the sensing voltage supply unit 121. The charging speed of the data line 14 according to this exemplary embodiment becomes much higher due to the precharging in the first period CT1.

Figure 15C:
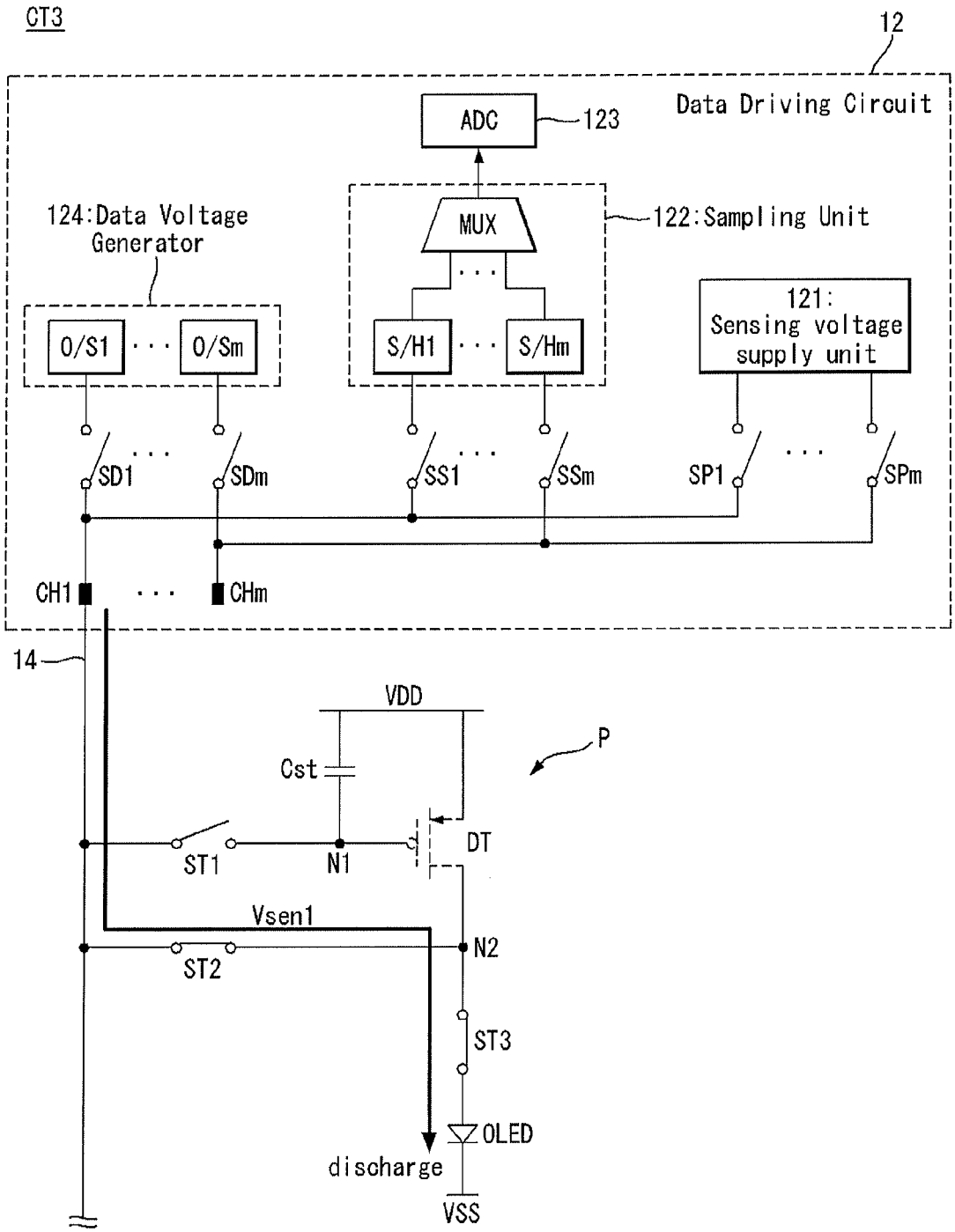

Referring to FIGS. 14 and 15C, during the third period CT3, the scan pulse SCN is maintained at the high logic level H to continuously turn off the first switching TFT ST1 of the pixel P, and the sensing pulse SEN and the emission pulse EM are maintained at the low logic level L to continuously turn on the second and third switching TFTs ST2 and ST3 of the pixel P. During the third period CT3, the first switch control signal ϕ 1 is generated at the turn-off level to turn off the switches SP1 to SPm in the data driving circuit 12. As a result, the data lines 14 are floated from the data driving circuit 12, and the first sensing voltage Vsen charged in the data line 14 is discharged by the low potential voltage source VSS until it has a potential equivalent to the threshold voltage Vth.oled of the organic light emitting diode OLED.

Figure 15D:
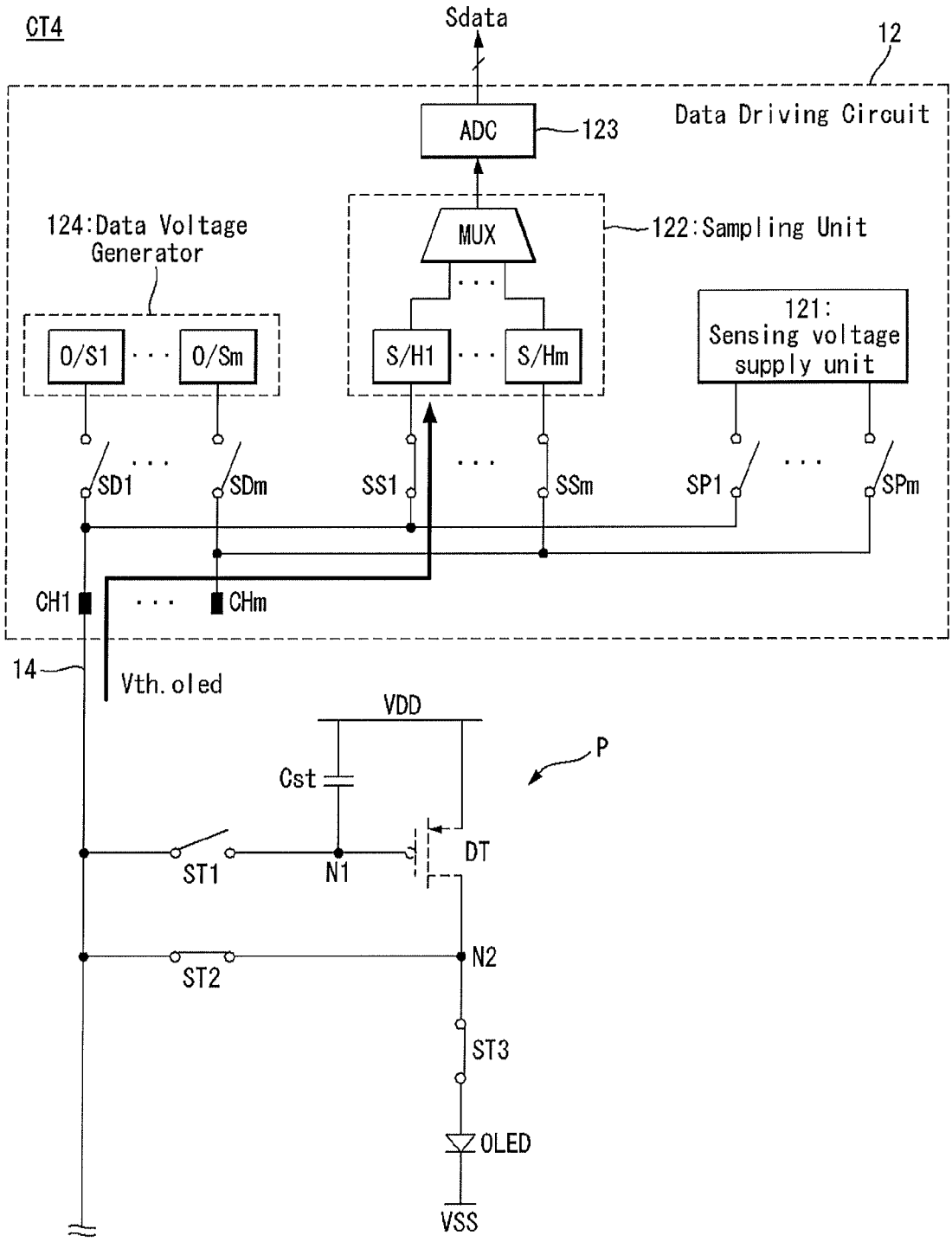

Referring to FIGS. 14 and 15D, during the fourth period CT4, the scan pulse SCAN is maintained at the high logic level H to continuously turn off the first switching TFT ST1 of the pixel P, and the sensing pulse SEN and the emission pulse EM are maintained at the low logic level L to continuously turn on the second and third switching TFTs ST2 and ST3 of the pixel P. During the fourth period CT4, the second switch control signal ϕ 2 is inverted to the turn-on level to turn on the switches SS1 to SSm in the data driving circuit 12. As a result, the threshold voltage Vth.oled of the organic light emitting diode OLED remaining in the data line 14 is sampled by the sampling unit 122, then passes through the ADC 123, and is converted into compensation data Sdata.

Figure 15E:
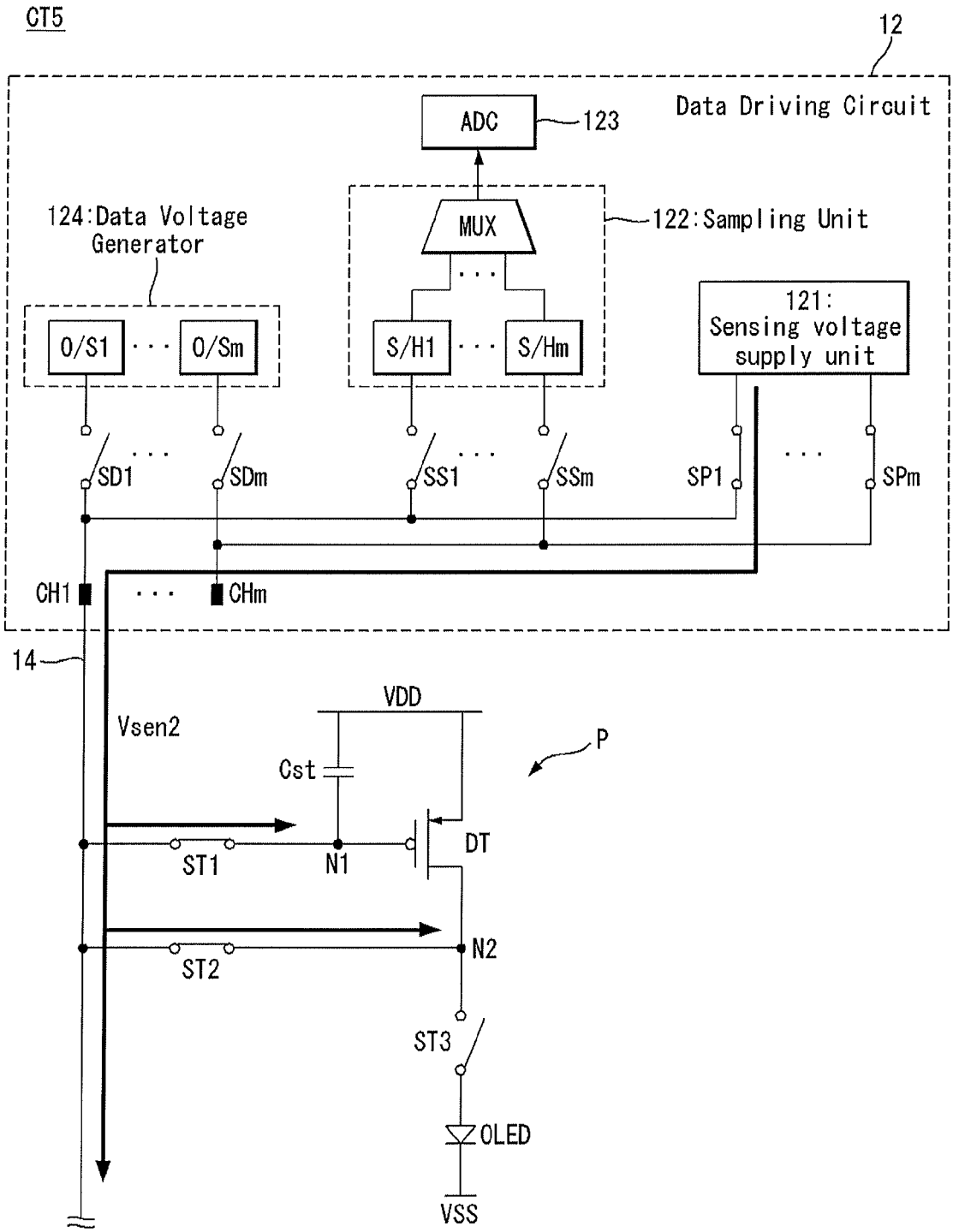

Referring to FIGS. 14 and 15E, during the fifth period. CT5, the scan pulse SCAN is inverted to the low logic level L to turn on the first switching TFT ST1 of the pixel P, the sensing pulse SEN is maintained at the low logic level L to continuously turn on the second switching TFT ST2 of the pixel P, and the emission pulse EM is inverted to the high logic level H to turn off the third switching TFT ST3 of the pixel P. During the fifth period CT5, the first switch control signal ϕ 1 is inverted to the turn-on level to turn on the switches SP1 to SPm in the data driving circuit 12. As a result, the data line 14 is firstly charged with a second sensing voltage Vsen2 from the sensing voltage supply unit 121. Here, the second sensing voltage Vsen2 is set lower than the threshold voltage Vth·DT of the driving TFT DT.

Figure 15F:
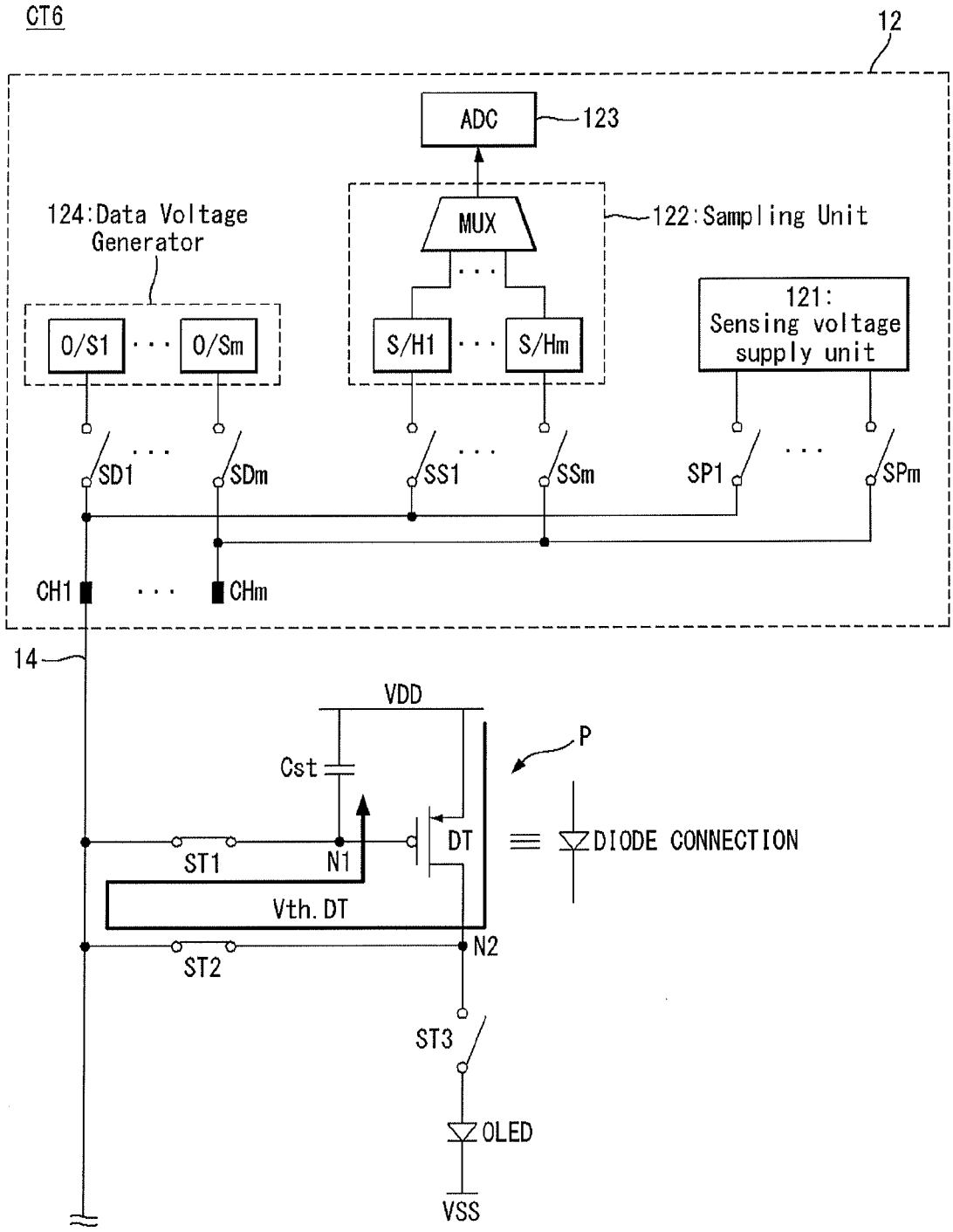

Referring to FIGS. 14 and 15F, during the sixth period CT6, the scan pulse SCAN and the sensing pulse SEN are maintained at the low logic level L to continuously turn on the first and second switching TFTs ST1 and ST2 of the pixel P, and the emission pulse EM is maintained at the high logic level H to continuously turn off the third switching TFT ST3 of the pixel P. During the sixth period CT6, the first switch control signal ϕ 1 is inverted to the turn-off level to turn off the switches SP1 to SPm in the data driving circuit 12. As a result, the data line 14 is floated from the data driving circuit 12, and is secondly charged at the level of the threshold voltage Vth·DT of the driving TFT DT by a diode connection of the driving TFT DT (short between the gate and drain electrodes of the driving TFT DT).

Figure 15G:
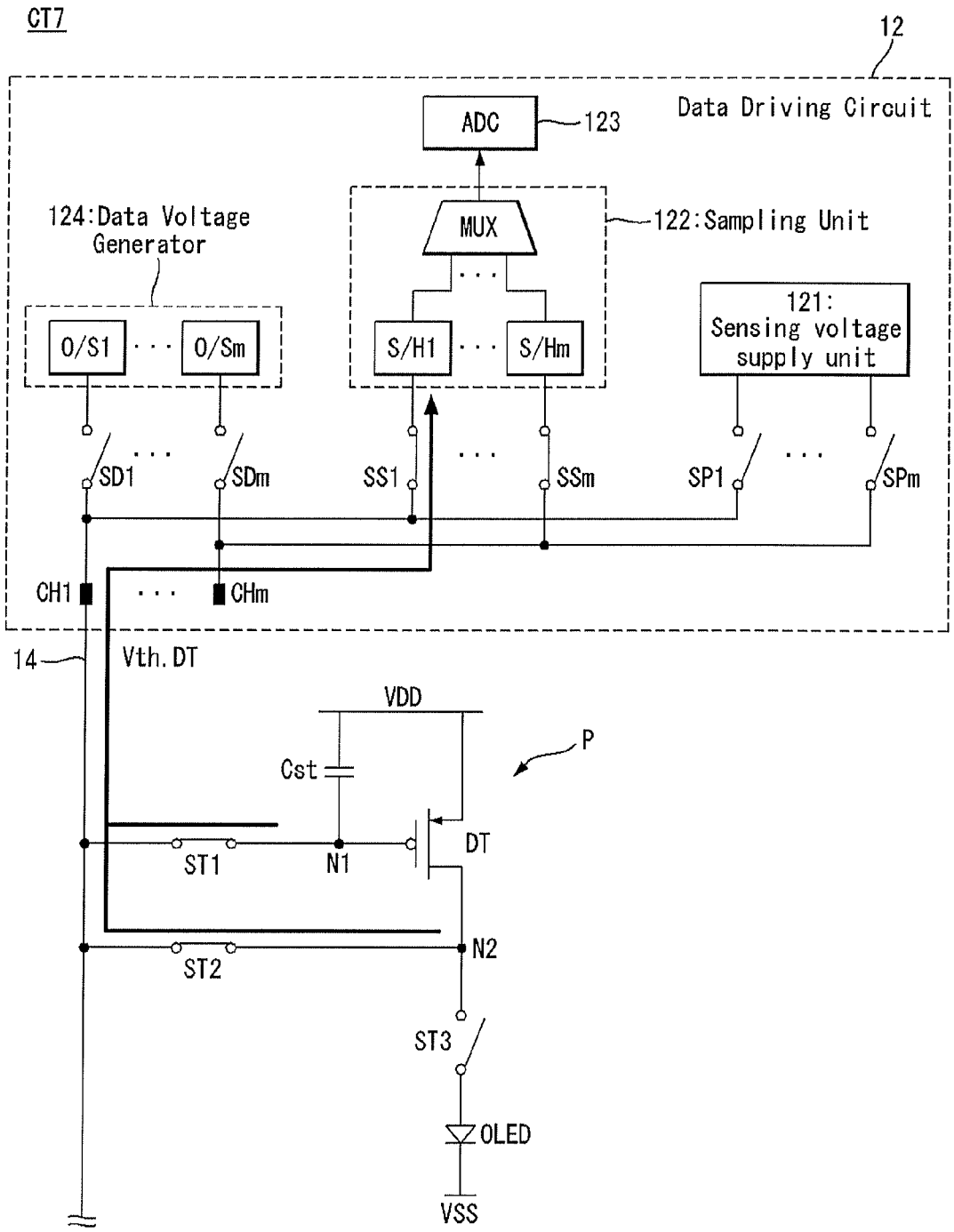

Referring to FIGS. 14 and 15G, during the seventh period CT7, the scan pulse SCAN and the sensing pulse SEN are maintained at the low logic level L to continuously turn on the third switching TFT ST3 of the pixel P. During the seventh period CT7, the second switch control signal ϕ 2 is inverted to the turn-on level to turn on the switches SS1 to SSm in the data driving circuit 12. As a result, the threshold voltage Vth·DT of the driving TFT DT on the data line 14 is sampled by the sampling unit 122, then passes through the ADC 123, and is converted into compensation data Sdata.

Next, the normal driving is sequentially performed for a first period DT1 for applying a data voltage Vdata and a second period DT2 for light emission.

Referring to FIGS. 14 and 16A, during the first period DT1, the scan pulse SCAN is generated at a low logic level L to turn on the first switching TFT ST1 of the pixel P, and the sensing pulse SEN and the emission pulse EM are generated at a high logic level H to turn off the second and third switching TFTs ST2 and ST3 of the pixel P. During the first period DT1, only the third switch control signal ϕ 3 is generated at a turn-on level to turn on the switches SD1 to SDm in the data driving circuit 12. As a result, the data voltage generator 124 converts modulated digital video data R'G'B' into a data voltage Vdata and supplies it to the data line 14. The difference in the deterioration of the driving TFTs DT, as well as the difference in the deterioration of the organic light emitting diodes OLEDs, is reflected in the data voltage Vdata. The data voltage Vdata is applied to the first node N1 of the pixel P.

Referring to FIGS. 14 and 16B, during the second period DT2, the scan pulse SCAN is inverted to the high logic level H to turn off the first switching TFT ST1 of the pixel P, the sensing pulse SEN is maintained at the high logic level H to continuously turn off the second switching TFT ST2 of the pixel P, and the emission pulse EM is inverted to the low logic level L to turn on the third switching TFT ST3 of the pixel P. During the second period DT2, only the third switch control signal ϕ 3 is maintained at the turn-on level to turn on the switches SD1 to SDm in the data driving circuit 12. As a result, the potential of the first node N1 is maintained at the data voltage Vdata. At this point, a driving current Ioled flowing in the organic light emitting diode OLED is as shown in the following Equation 1:

[Equation 2]

$$Ioled = \frac{k}{2}(Vsg - Vth \cdot DT)^2 \quad \text{(A)}$$

$$= \frac{k}{2}(Vdd - Vdata - Vth \cdot DT)^2 \quad \text{(C)}$$

where k denotes a constant determined by mobility, parasitic capacitance, and channel length, and Vsg denotes a voltage between the source and gate of the driving TFT DT. As stated above in detail, since both the difference in the deterioration of the organic light emitting diodes OLEDs and the difference in the deterioration of the driving TFTs DT are reflected in the data voltage Vdata, the driving current Ioled according to the present invention is not dependent upon these deterioration differences.

FIG. 17 shows another example of a pixel P to which the second compensation scheme is applied. The data line portion 14 connected to this pixel P comprises only a data line.

Referring to FIG. 17, this pixel P further comprises a fourth switching TFT ST4 in addition to the pixel structure of FIG. 13. The fourth switching TFT ST4 is connected between the high potential voltage source VDD and the first node, and is switched in response to a scan pulse SCAN(n−1) from a front stage scan pulse supply line 15A(n−1). As the potential of the firsit node N1 is preliminarily initialized to the high potential driving voltage Vdd by the turn on of the fourth switching TFT ST4, the hysteresis characteristics of the driving TFT DT in the pixel structure according to this exemplary embodiment are greatly improved even if no high potential driving voltage Vdd is externally applied. The other components of this pixel P except the fourth switching TFT ST4 are substantially identical to those of FIG. 13. The operations of the data driving circuit 12 and the pixel P during compensation driving and the operations of the data driving circuit 12 and the pixel P during normal driving are substantially identical to those in FIGS. 14 to 16B.

As described above in detail, the organic light emitting diode display and the driving method thereof according to the present invention can increase the accuracy of compensation for a difference in the deterioration of the organic light emitting diodes and greatly reduce the time required for compensation in such a manner as to externally supply a sensing voltage.

Moreover, the organic light emitting diode display and the driving method thereof according to the present invention can compensate for a difference in the deterioration of the driving TFTs, as well as a difference in the deterioration of the organic light emitting diodes.

From the above description, it will be apparent to those skilled in the art that various changes and modifications can be made without departing from the technical spirit of the present invention. Accordingly, the scope of the present invention should not be limited by the exemplary embodiments, but should be defined by the appended claims.

What is claimed is:

1. An organic light emitting diode display, comprising:

a display panel comprising a plurality of pixels arranged in a matrix at intersections of gate line portions and data line portions and each pixel having an organic light emitting diode, and a driving TFT that controls the amount of current flowing in the organic light emitting diode;

a memory that stores compensation data;

a timing controller that modulates input digital video data based on the compensation data and generates modulated data; and a data driving circuit that, during compensation driving, generates the compensation data to compensate for a difference of the deterioration between the organic light emitting diodes in the display panel by supplying a sensing voltage to the pixels and sampling the threshold voltage of the organic light emitting diodes, which is fed back from the pixels, and that, during normal driving, converts the modulated data into a data voltage and supplying the data voltage to the pixels, wherein the compensation driving is sequentially performed during a first period for charging a data line of the data line portions with the sensing voltage, a second period for floating the data line and then discharging the sensing voltage on the data line via the organic light emitting diode, and a third period for sampling a sensing voltage on a the data line remained after the discharging with the threshold voltage of the organic light emitting diode, where the normal driving is sequentially performed during a fourth period for sensing a difference of the deterioration between the driving TFTs in the display panel and a fifth period for light emission of the organic light emitting diode, and wherein the data driving circuit includes:

a sensing voltage supply unit that generates the sensing voltage to sense the deterioration of the organic light emitting diodes during the first period;

a sampling unit that samples the threshold voltage value of the organic light emitting diode depending on the deterioration of the organic light emitting diode fed back from the pixels during the third period;

an ADC that analog-digital converts the threshold voltage values sampled by the sampling unit to generate the compensation data, and supplying the compensation data to the memory; and a data voltage generator that converts the modulated data into the data voltage and supplies the data voltage to the pixels during the fourth and fifth periods.

2. The organic light emitting diode display of claim 1, wherein the data driving circuit further comprises:

a first switch array to be switched between the sensing voltage supply unit and the data line portions in response to a first switch control signal from the timing controller;

a second switch array to be switched between the sampling unit and the data line portions in response to a second switch control signal from the timing controller; and a third switch array to be switched between the data voltage generator and the data line portions in response to a third switch control signal from the timing controller.

3. The organic light emitting diode display of claim 2, wherein each of the gate line portions comprises a scan pulse supply line that applies a scan pulse, an emission pulse supply line that applies an emission pulse, and a sensing pulse supply line that applies a sensing pulse.

4. The organic light emitting diode display of claim 3, wherein each of the pixels comprises:

the driving TFT connected between a high potential voltage source and the organic light emitting diode, which controls the amount of current flowing in the organic light emitting diode according to a voltage difference between the high potential voltage source and a first node;

a first switching TFT connected between the first node and the driving TFT, and switched in response to the scan pulse;

a second switching TFT connected between the data line and a second node, and switched in response to the scan pulse;

a third switching TFT connected between a reference voltage source and the second node, and switched in response to the emission pulse;

a fourth switching TFT connected between the driving TFT and the organic light emitting diode, and switched in response to the emission pulse;

a fifth switching TFT connected between the data line and a third node, and switched in response to the sensing pulse;

the organic light emitting diode connected between the third node and a low potential voltage source; and a storage capacitor connected between the first node and the second node.

5. The organic light emitting diode display of claim 4, wherein, during the first period, the first switch array is turned on and the fifth switching TFT is turned off;

during the second period, the first switch array is turned off and the fifth switching TFT is turned on; and during the third period, the second switch array is turned on and the fifth switching TFT is turned on.

6. The organic light emitting diode display of claim 2, wherein each of the data line portions comprises a data line for applying the data voltage and a sensing voltage supply line for applying the sensing voltage; and each of the gate line portions comprises a scan pulse supply line for applying a scan pulse, an emission pulse supply line for applying an emission pulse, and a sensing pulse supply line for applying a sensing pulse.

7. The organic light emitting diode display of claim 6, wherein each of the pixels comprises:

the driving TFT connected between a high potential voltage source and the organic light emitting diode, which controls the amount of current flowing in the organic light emitting diode according to a voltage difference between the high potential voltage source and a first node;

a first switching TFT connected between the first node and the driving TFT, and switched in response to the scan pulse;

a second switching TFT connected between the data line and a second node, and switched in response to the scan pulse;

a third switching TFT connected between a reference voltage source and the second node, and switched in response to the emission pulse;

a fourth switching TFT connected between the driving TFT and the organic light emitting diode, and switched in response to the emission pulse;

a fifth switching TFT connected between the sensing voltage supply line and a third node, and switched in response to the sensing pulse;

the organic light emitting diode connected between the third node and a low potential voltage source; and a storage capacitor connected between the first node and the second node.

8. The organic light emitting diode display of claim 6, wherein each of the pixels comprises:

the driving TFT connected between a high potential voltage source and the organic light emitting diode, which controls the amount of current flowing in the organic light emitting diode according to a voltage difference between the high potential voltage source and a first node;

a first switching TFT connected between the first node and the driving TFT, and switched in response to the scan pulse;

a second switching TFT connected between the data line and a second node, and switched in response to the scan pulse;

a third switching TFT connected between a reference voltage source and the second node, and switched in response to the emission pulse;

a fourth switching TFT connected between the driving TFT and the organic light emitting diode, and switched in response to the emission pulse;

a fifth switching TFT connected between a third node between the driving TFT and the fourth switching TFT and the sensing voltage supply line, and switched in response to the sensing pulse;

the organic light emitting diode connected between the third node and a low potential voltage source; and a storage capacitor connected between the first node and the second node.

9. An organic light emitting diode display, comprising:

a display panel comprising a plurality of pixels arranged in a matrix at intersections of gate line portions and data line portions and each having an organic light emitting diode and a driving TFT that controls amount of current flowing in the organic light emitting diode;

a memory that stores compensation data including a first compensation data and second compensation data;

a timing controller that modulates input digital video data based on the compensation data and generates modulated data; and a data driving circuit that, during compensation driving, generates the compensation data to compensate for a difference of the deterioration between the organic light emitting diodes in the display panel and a difference of the deterioration between the driving TFTs by supplying first and second sensing voltages to the pixels and sampling the threshold voltage of the organic light emitting diodes and the threshold voltage of the driving TFTs, which are fed back from the pixels, and that, during normal driving, converts the modulated data into a data voltage and supplying the data voltage to the pixels, wherein the compensation driving is sequentially performed during a first period for precharging a data line of the data line portions with a high potential driving voltage, a second period for charging the data line with the first sensing voltage, a third period for floating the data line and then discharging the first sensing voltage on the data line via the organic light emitting diode, a fourth period for sampling a first sensing voltage on the data line remained after the discharging with the threshold voltage of the organic light emitting diode, a fourth period for charging the data line with the second sensing voltage, a sixth period for floating the data line and then charging the data line with the threshold voltage of the driving TFT higher than the second sensing voltage, and a seventh period for sampling the threshold voltage of the driving TFT on the data line, where the normal driving is sequentially performed during an eighth period for supplying the data voltage and a ninth period for light emission of the organic light emitting diode, and wherein the data driving circuit includes:

a sensing voltage supply unit that generates the high potential voltage during the first period, the first sensing voltage during the second period, and the second sensing voltage during the fifth period;

a sampling unit that samples the threshold voltage of the organic light emitting diode during the fourth period and the threshold voltage of the driving TFT during the seventh period;

an ADC that analog-digital converts the sampled threshold voltage of the organic light emitting diode to generate the first compensation data during the fourth period, and the sampled threshold voltage of the driving TFT to generate the second compensation data during the seventh period; and a data voltage generator that converts the modulated data into the data voltage during the eighth and ninth periods.

10. The organic light emitting diode display of claim 9, wherein the data driving circuit further comprises:

a first switch array to be switched between the sensing voltage supply unit and the data line portions in response to a first switch control signal from the timing controller;

a second switch array to be switched between the sampling unit and the data line portions in response to a second switch control signal from the timing controller; and a third switch array to be switched between the data voltage generator and the data line portions in response to a third switch control signal from the timing controller.

11. The organic light emitting diode display of claim 10, wherein each of the gate line portions comprises a scan pulse supply line for applying a scan pulse, an emission pulse supply line for applying an emission pulse, and a sensing pulse supply line for applying a sensing pulse.

12. The organic light emitting diode display of claim 11, wherein each of the pixels comprises:

the driving TFT connected between a high potential voltage source and the organic light emitting diode, and controlling the amount of current flowing in the organic light emitting diode according to a voltage difference between the high potential voltage source and a first node;

a first switching TFT connected between the first node and the data line, and switched in response to the scan pulse;

a second switching TFT connected between the data line and a second node, and switched in response to the sensing pulse;

a third switching TFT connected between the second node and the organic light emitting diode, and switched in response to the emission pulse;

the organic light emitting diode connected between the third switching TFT and a low potential voltage source; and a storage capacitor connected between the first node and the high potential voltage source.

13. The organic light emitting diode display of claim 12, wherein, during the first period, the first switch array is turned on, the first and third switching TFTs are turned on, and the second switching TFT is turned off;

during the second period, the first switch array is turned on, the first switching TFT is turned off, and the second and third switching TFTs are turned on;

during the third period, the first switching array is turned off, the first switching TFT is turned off, and the second and third switching TFTs are turned on;

during the fourth period, the second switching array is turned on, the first switching TFT is turned off, and the second and third switching TFTs are turned on;

during the fifth period, the first switching array is turned on, the first and second switching TFTs are turned on, and the third switching TFT is turned off;

during the sixth period, the first switch array is turned off, the first and second switching TFTs are turned on, and the third switching TFT is turned off; and during the seventh period, the second switching array is turned on, the first and second switching TFTs are turned on, and the third switching TFT is turned off.

14. The organic light emitting diode display of claim 12, wherein each of the pixels further comprises a fourth switching TFT connected between the high potential voltage source and the first node, and switched in response to a scan pulse of an adjacent front stage.

* * * * *